US012624482B2

(12) United States Patent
Brunner et al.

(10) Patent No.: US 12,624,482 B2
(45) Date of Patent: May 12, 2026

(54) NONWOVEN FABRICS COMPRISING POLYLACTIC ACID AND SURFACE-TREATED CALCIUM CARBONATE

(71) Applicant: OMYA INTERNATIONAL AG, Oftringen (CH)

(72) Inventors: Martin Brunner, Wallbach (CH); Christophe Roux, Lyons (FR); Simon Fremeaux, Emmerin (FR)

(73) Assignee: OMYA INTERNATIONAL AG, Oftringen (CH)

( * ) Notice: Subject to any disclaimer, the term of this patent is extended or adjusted under 35 U.S.C. 154(b) by 467 days.

(21) Appl. No.: 17/786,164

(22) PCT Filed: Jan. 12, 2021

(86) PCT No.: PCT/EP2021/050441
§ 371 (c)(1),
(2) Date: Jun. 16, 2022

(87) PCT Pub. No.: WO2021/151651
PCT Pub. Date: Aug. 5, 2021

(65) Prior Publication Data

US 2023/0047798 A1 Feb. 16, 2023

(30) Foreign Application Priority Data

Jan. 29, 2020 (EP) ..... 20154400

(51) Int. Cl.
*D04H 1/55* (2012.01)
*D01F 1/10* (2006.01)
(Continued)

(52) U.S. Cl.
CPC ..... *D04H 1/55* (2013.01); *D01F 1/10* (2013.01); *D01F 6/625* (2013.01); *D04H 1/492* (2013.01);
(Continued)

(58) Field of Classification Search
None
See application file for complete search history.

(56) References Cited

U.S. PATENT DOCUMENTS 7,507,561 B2 3/2009 Ramakrishna et al.
2005/0255768 A1* 11/2005 Iwasaki ..... D04H 3/14 442/44
(Continued)

FOREIGN PATENT DOCUMENTS

EP 2371766 A1 10/2011
EP 2447213 A1 5/2012
(Continued)

OTHER PUBLICATIONS

Apr. 30, 2021 International Search Report issued in International Patent Application No. PCT/EP2021/050441.
(Continued)

*Primary Examiner* — Farah Taufiq
(74) *Attorney, Agent, or Firm* — Oliff PLC

(57) ABSTRACT

A process for the production of a nonwoven fabric. In particular, it relates to the production of a nonwoven fabric having desirable tactile and haptic as well as mechanical properties, as well as to the nonwoven fabric itself. The process requires the selection of specific polylactic acid polymers and corresponding process conditions.

7 Claims, 2 Drawing Sheets

Hydroentanglement step

(51) Int. Cl.
*D01F 6/62* (2006.01)
*D04H 1/492* (2012.01)
*D04H 1/56* (2006.01)

(52) U.S. Cl.
CPC ..... *D04H 1/56* (2013.01); *D10B 2331/041* (2013.01); *D10B 2401/12* (2013.01)

(56) References Cited

U.S. PATENT DOCUMENTS

| | | | | |
|---|---|---|---|---|
| 2015/0322604 | A1* | 11/2015 | Brunner | D04H 3/011 264/210.8 |
| 2017/0204536 | A1* | 7/2017 | Brunner | D01F 6/62 |
| 2019/0390020 | A1 | 12/2019 | Ferris et al. | |

FOREIGN PATENT DOCUMENTS

| | | | |
|---|---|---|---|
| EP | 2524898 | A1 | 11/2012 |
| EP | 2607399 | A1 | 6/2013 |
| EP | 2722368 | A1 | 4/2014 |
| EP | 2749679 | A1 | 7/2014 |
| EP | 2840065 | A1 | 2/2015 |
| EP | 2963162 | A1 | 1/2016 |
| WO | 2004/057008 | A1 | 7/2004 |
| WO | 2010/098514 | A1 | 9/2010 |
| WO | 2013/142473 | A1 | 9/2013 |
| WO | 2014/060286 | A1 | 4/2014 |
| WO | 2014/128087 | A1 | 8/2014 |
| WO | 2016/087286 | A1 | 6/2016 |
| WO | 2019/202420 | A1 | 10/2019 |

OTHER PUBLICATIONS

Apr. 30, 2021 Written Opinion issued in International Patent Application No. PCT/EP2021/050441.

* cited by examiner

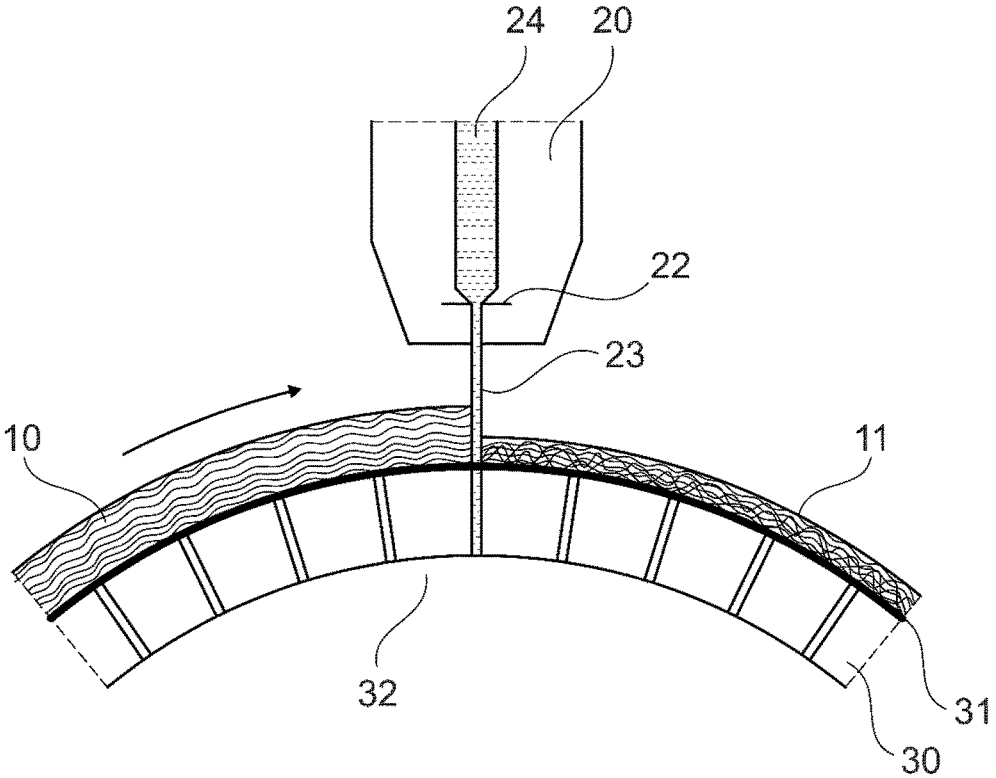
Fig. 1. Hydroentanglement step

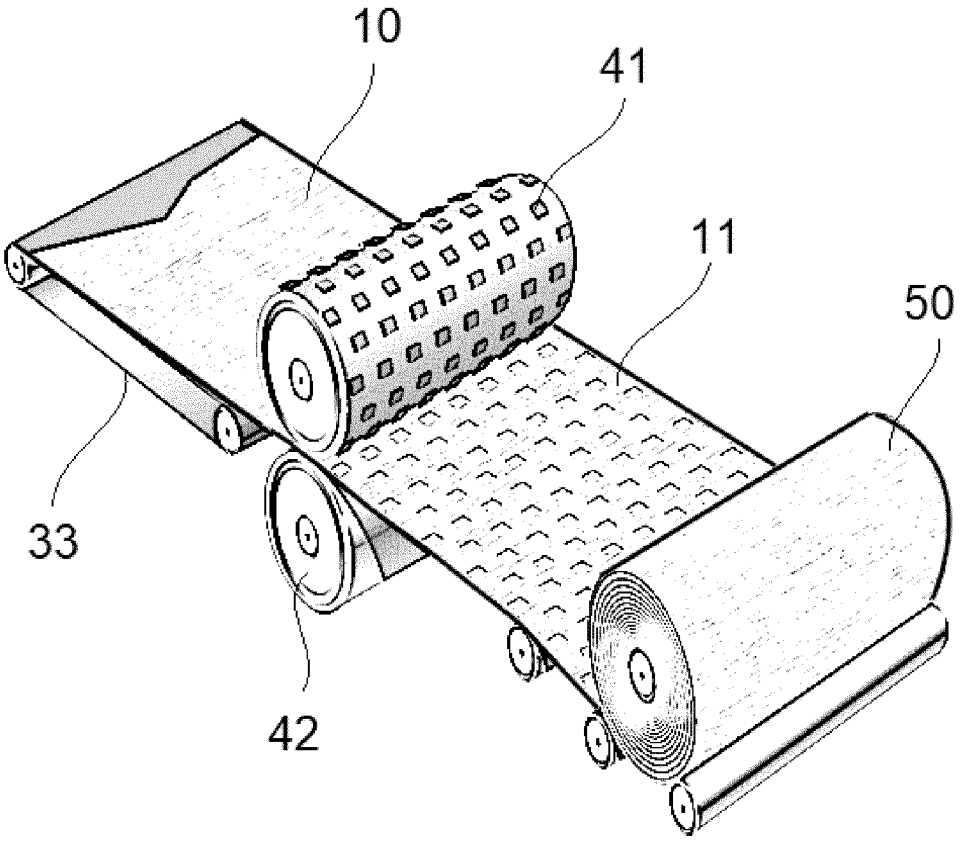
Fig. 2. Calendering step

NONWOVEN FABRICS COMPRISING POLYLACTIC ACID AND SURFACE-TREATED CALCIUM CARBONATE

The present invention relates to a process for producing a nonwoven fabric comprising a polylactic acid polymer and a surface-treated calcium carbonate-containing filler material, a nonwoven fabric comprising a polylactic acid polymer and a surface-treated calcium carbonate-containing filler material, the use of a surface-treated calcium carbonate-containing filler material for the manufacture of a nonwoven fabric comprising a polylactic acid polymer, and an article comprising the nonwoven fabric.

Nonwoven fabrics are flexible sheet or web structures, which are composed of an interlocked network of staple fibers and/or filaments, which are used in a variety of consumer and industrial applications, such as in absorbent hygiene products, agriculture and horticulture, clothing and footwear, filtration, geotextiles and the like. Due to their absorbent properties, they are frequently used in personal care products, such as absorbent hygiene products, baby wipes, cleansing wipes, or antibacterial wipes.

Today, nonwoven fabrics are mainly produced from synthetic thermoplastic polymers, such as polypropylene, polyethylene, polyesters, e.g., polyethylene terephthalate, or polyamides. These materials typically originate from non-renewable sources, such as fossil fuels, and are non-biodegradable. As a consequence, the utilization of nonwoven fabrics formed from synthetic polymers at their end of life typically is limited to energetic recycling, i.e., the materials have to be burned. Furthermore, if such nonwovens are used in geotextiles or are discarded in nature, they may remain permanently in the soil without decomposing, thus representing a threat for the environment.

In recent years, biodegradable polymers emerged as a viable alternative to fossil-fuel derived conventional polymers. Biodegradable polymers are specific types of polymers that decompose after having fulfilled their intended purpose, yielding natural byproducts such as gases, water, biomass, and inorganic salts. These polymers can be derived from both natural and synthetic sources, and typically comprise ester-, amide-, and ether-containing repeating groups. Representative materials are known in the prior art.

One known bio-degradable polymer is polylactic acid or polylactide (PLA). PLA is a bio-degradable thermoplastic aliphatic polyester derived from renewable resources, such as corn starch, tapioca roots, chips or starch, or sugarcane. Due to the chiral nature of lactic acid, several distinct forms of polylactide exist. For example, poly-L-lactide (PLLA) is the product resulting from polymerization of L,L-lactide (also known as L-lactide). In 2019, PLA had the second highest production volume of bioplastic worldwide.

Depending on their intended field of application, nonwoven fabrics may show a range of desirable material properties, i.e., mechanical properties (such as high tensile strength, both in machine direction (MD) and cross direction (CD), tear resistance, high puncture resistance, flexibility, and abrasion resistance), haptic properties (such as smoothness, softness, or a "cotton-feel"), and other properties (such as absorbency and breathability). In order to improve one or more of these material properties of nonwoven fabrics, it was suggested to incorporate inorganic fillers, such as particulate calcium carbonate, into the fibers of the nonwoven fabric. However, the incorporation can lead to lower tensile strength of the fibers, which causes processing issues, such as fiber breakages, pressure buildup at the die, or "sticky" fibers, and deteriorates the mechanical properties of the nonwoven fabric. Furthermore, there are specific issues associated with the incorporation of calcium carbonate fillers in a PLA fiber. In particular, calcium carbonate may catalyze the cleavage of the ester moieties in the PLA, leading to a deterioration of the mechanical properties or fiber breakages during spinning. This effect is more pronounced at elevated temperatures, such as those temperatures occurring during filament extrusion, which effectively limits the processability of calcium carbonate-filled PLA fibers.

In the production process of nonwoven fabrics, the obtained fibers finally have to be consolidated in a web bonding step to yield a nonwoven fabric having a suitable strength for the intended applications. Commonly employed methods include thermobonding, also called calendering, or chemical bonding. Alternative processes may be needlepunching or hydroentanglement. Needlepunching tends to impart significant material stress to the nonwoven fabric, and may lead to fiber breakage and deterioration of mechanical strength of the material. Hydroentangling, also known as spunlacing, is a process, which employs high pressure water jets to entangle fibers in a loose web, thereby creating a fabric held together by frictional forces between said fibers.

There is a need for processes, which allow for the formation of a bio-based, biodegradable nonwoven fabric having desirable haptic properties, while at the same time preferably retaining or improving the desired mechanical properties.

Accordingly, it is an objective of the present invention to provide a process for the production of a bio-based, biodegradable nonwoven fabric having desirable tactile and haptic properties, while essentially retaining or improving the desired mechanical properties of the nonwoven. It would also be desirable to provide such process, which can be performed without die-buildup and/or fiber breakages. Furthermore, it would also be desirable to provide a nonwoven fabric containing a reduced amount of polymer without affecting the quality of the nonwoven significantly in order to lower the overall cost of the nonwoven fabric.

The foregoing and other objectives are solved by the subject-matter as defined in the claims enclosed herewith.

According to a first aspect of the present invention, a process for producing a nonwoven fabric is provided. The process comprises the steps of a) providing a surface-treated calcium carbonate-containing filler material, the surface-treated calcium carbonate-containing filler material comprising a calcium carbonate-containing filler material and a surface-treatment layer on at least a part of the surface of said calcium carbonate-containing filler material, wherein the surface-treatment layer is formed by contacting the calcium carbonate-containing filler material with a surface treatment agent, wherein the surface treatment agent comprises at least one mono-substituted succinic anhydride and/or mono-substituted succinic acid and/or a salt thereof;

b) providing a first polylactic acid polymer, preferably having a melt flow rate MFR (210° C./2.16 kg) in the range of 10 to 40 g/10 min, as measured according to EN ISO 1133:2011;

c) providing a second polylactic acid polymer being the same or different from the first polylactic acid polymer and preferably having a melt flow rate MFR (210° C./2.16 kg) in the range of 10 to 40 g/10 min, as measured according to EN ISO 1133:2011;

d) forming a masterbatch by compounding the surface-treated calcium carbonate-containing filler material of step a) in an amount of from 20 to 80 wt.-%, preferably from 40 wt. % to 60 wt.-%, based on the total weight of the masterbatch, with the first polylactic acid polymer of step b);

e) mixing the masterbatch of step d) with the second polylactic acid polymer of step c) to obtain a mixture;

f) forming the mixture of step e) into fibers;

g) forming a fibrous web from the fibers of step f); and h) forming the non-woven fabric by calendering or hydroentanglement of the fibrous web of step g).

The inventors surprisingly found that the foregoing process allows for obtaining a biodegradable nonwoven fabric having desirable haptic properties, such as an improved softness and a natural "cotton-feel", while retaining or even improving the mechanical properties, by virtue of the interplay of the process steps and parameters outlined herein. In particular, the inventors surprisingly found that a calcium carbonate-containing filler material, having a specific particle size distribution and a specific surface-treatment layer can be uniformly dispersed in a first polylactic acid polymer by the formation of a masterbatch having a specific concentration of the surface-treated calcium carbonate-containing filler material. The masterbatch, comprising the uniformly dispersed surface-treated calcium carbonate-containing filler material, according to the present invention is then mixed with a second polylactic acid polymer to form a mixture, which can be formed into fibers. These fibers, after a suitable laying and bonding step, form a nonwoven fabric having the desired haptic and mechanical properties. Due to the uniform dispersion of the calcium carbonate-containing filler material in the mixture, the fiber spinning process becomes more stable, even at reduced extrusion temperatures, and can proceed essentially without fiber breakages and at an increased line speed.

It is commonly known that polylactic acid shows a high build-up of static electricity, in particular during filament extrusion and nonwoven fabric formation. The addition of the surface-treated calcium carbonate-containing filler material reduces the static electricity effect, which allows for an easier and safer processing of the filled fibers. At the same time, the filled fibers, compared to non-filled polylactic acid fibers, do not stick to heated rolls, such as engraved rolls, which are used in the calendering process, even at elevated temperatures.

The ability to increase the temperature of the heated rolls and the "non-stick" effect allow for an increased flexibility in the web bonding step and other post-processing steps, such as embossing or printing steps. In addition, due to the presence of the calcium carbonate-containing filler material, the resulting nonwoven has a visually appealing matt effect.

The present inventors also found that the surface-treatment layer on the calcium carbonate-containing filler material, which is formed from mono-substituted succinic anhydrides or their derivatives, inhibits reactions of the basic calcium carbonate with the ester moieties of the polylactic acid polymer, thus reducing or essentially inhibiting cleavage of the ester moieties before, during and after processing, even at elevated temperatures. This chemical stabilizing effect prevents deterioration of the polylactic acid polymer and the mechanical, optical and haptic properties of the nonwoven fabric.

Advantageous embodiments of the inventive process for preparing a nonwoven fabric are defined in the corresponding dependent claims.

In one embodiment, the calcium carbonate-containing filler material has prior to the surface treatment i) a weight median particle size ($d_{50}$) value in the range from 0.1 μm to 7 μm, ii) a top cut ($d_{98}$) value of 15 μm or less, iii) a specific surface area (BET) from 0.5 to 120 $m^2/g$, as measured by the BET method, and/or iv) a residual total moisture content from 0.01 wt.-% to 1 wt.-%, based on the total dry weight of the at least one calcium carbonate-containing filler material.

In another embodiment, the mixture of step e) has a surface-treated calcium carbonate-containing filler material content in the range of 5 to 25 wt.-%, preferably 5 wt.-% to 15 wt.-%, based on the total weight of the mixture.

In yet another embodiment, the fibers formed in step f) are filaments having an average fiber diameter in the range from 9 to 25 μm, preferably from 12 to 21 μm, and/or a titer in the range from 1 to 6 dtex, preferably 1.5 to 4 dtex, as measured by EN ISO 2062:2009, and/or are formed from the mixture of step e) by spunbonding, wherein preferably the mixture of step e) is extruded at a temperature from 210° C. to 250° C., preferably from 215 to 235° C., and most preferably from 220° C. to 225° C.

The fibers formed in step f) may also be staple fibers having an average fiber diameter in the range from 9 to 25 μm, preferably from 12 to 21 μm, and/or a titer in the range from 1 to 6 dtex, preferably 1.5 to 4 dtex, as measured by EN ISO 2062:2009 and/or a staple fiber length in the range from 30 to 90 mm, preferably 40 to 60 mm, wherein the staple fibers are preferably formed from the mixture of step e) by a process comprising the steps of multifilament or monofilament extrusion and cutting, and/or wherein the staple fibers are formed into a fibrous web during step g) preferably by carding.

In another embodiment, the non-woven fabric is formed in step h) by hydroentanglement and preferably the pre-bonding step is performed at a water pressure of about 50 to 120 bar, preferably 60 to 110 bar, more preferably 65 to 105 bar, and/or the water pressure does not exceed 250 bar, preferably 225 bar, more preferably 200 bar and/or the water pressure of the final bonding step is in the range of 90 to 250 bar, preferably 95 to 225 bar, more preferably 100 to 200 bar, and/or at least 95%, preferably at least 98%, more preferably at least 99% of the process water is reused, and/or the nonwoven fabric is dried after the final bonding step at a temperature below 135° C., more preferably below 120° C., even more preferably below 100° C.

The non-woven fabric may also be formed in step h) by calendering. Preferably, calendering is performed at a temperature in the range from 120 to 160° C., preferably from 130 to 150° C., or from 140° C. to 160° C. and/or at a pressure in the range from 10 to 70 N/mm, more preferably from 20 to 60 N/mm, and most preferably from 25 to 55 N/mm, for example about 30 N/mm or about 50 N/mm.

A second aspect of the present invention relates to a nonwoven fabric formed from fibers composed of a mixture comprising a first polylactic acid polymer, a second polylactic acid polymer being the same or different than the first polylactic acid polymer and a surface-treated calcium carbonate-containing filler material comprising a calcium carbonate-containing filler material and a surface-treatment layer on at least a part of the surface of said calcium carbonate-containing filler material, wherein the surface-treatment layer is formed by contacting the calcium carbonate-containing filler material with a surface treatment agent, and wherein the surface treatment agent comprises at least one mono-substituted succinic anhydride and/or mono-substituted succinic acid and/or a salt thereof.

The inventors surprisingly found that a nonwoven fabric, which is obtained from a mixture of the foregoing specific polylactic acid polymers and the specific surface-treated calcium carbonate-containing filler material in the defined specific amounts, provides the desirable haptic and mechanical properties. The inventive nonwoven fabric can be obtained by the specific process as described herein, which can be adjusted to yield a nonwoven fabric having the envisaged properties, e.g., by the specific fiber forming and calendering or hydroentanglement conditions described herein.

Advantageous embodiments of the inventive nonwoven fabric are defined in the corresponding dependent claims and the exemplary embodiments as follows.

In one embodiment, the calcium carbonate-containing filler material has prior to the surface treatment i) a weight median particle size ($d_{50}$) value in the range from 0.1 μm to 7 μm, ii) a top cut ($d_{98}$) value of 15 μm or less, iii) a specific surface area (BET) from 0.5 to 120 $m^2/g$, as measured by the BET method, and/or iv) a residual total moisture content from 0.01 wt.-% to 1 wt.-%, based on the total dry weight of the at least one calcium carbonate-containing filler material.

Additionally or alternatively, the surface-treatment layer is formed by contacting the calcium carbonate-containing filler material with a surface treatment agent in an amount from 0.1 to 3.0 wt.-%, preferably 0.1 to 2.5 wt.-%, more preferably 0.1 to 2.0 wt.-%, and most preferably 0.2 to 1.0 wt.-%, based on the total dry weight of the calcium carbonate-containing filler material. The nonwoven fabric may be formed by a process comprising a calendering or hydroentanglement step.

According to the present invention, the mixture may comprise from 5 to 25 wt.-%, preferably from 5 to 15 wt.-% of the surface-treated calcium carbonate-containing filler material.

In one embodiment, the first polylactic acid polymer has a melt flow rate MFR (210° C./2.16 kg) in the range from 10 to 40 g/10 min, as measured according to EN ISO 1133:2011, and/or the second polylactic acid polymer has a melt flow rate MFR (210° C./2.16 kg) in the range from 10 to 40 g/10 min, as measured according to EN ISO 1133:2011.

In yet another embodiment, the fibers are filaments having an average fiber diameter in the range from 9 to 25 μm, preferably from 12 to 21 μm, and/or a titer in the range from 1 to 6 dtex, preferably 1.5 to 4 dtex, as measured by EN ISO 2062:2009, and/or are formed from the mixture by spunbonding, wherein preferably the mixture is extruded at a temperature from 210° C. to 250° C., preferably from 215 to 235° C., and most preferably from 220° C. to 225° C.

Alternatively, the fibers may also be staple fibers having an average fiber diameter in the range from 9 to 25 μm, preferably from 12 to 21 μm, and/or a titer in the range from 1 to 6 dtex, preferably 1.5 to 4 dtex, as measured by EN ISO 2062:2009 and/or a staple fiber length in the range from 30 to 90 mm, preferably 40 to 60 mm, wherein the staple fibers are preferably formed from the mixture by a process comprising the steps of multifilament or monofilament extrusion, cutting, and preferably carding.

According to the present invention, the non-woven fabric may be formed by hydroentanglement and preferably the pre-bonding step is performed at a water pressure of about 50 to 120 bar, preferably 60 to 110 bar, more preferably 65 to 105 bar, and/or the water pressure does not exceed 250 bar, preferably 225 bar, more preferably 200 bar and/or the water pressure of the final bonding step is in the range of 90 to 250 bar, preferably 95 to 225 bar, more preferably 100 to 200 bar, and/or at least 95%, preferably at least 98%, more preferably at least 99% of the process water is reused, and/or the nonwoven fabric is dried after the final bonding step at a temperature below 135° C., more preferably below 120° C., even more preferably below 100° C.

The non-woven fabric may also be formed by calendering. Preferably, calendering is performed at a temperature in the range from 120 to 160° C., preferably from 130 to 150° C., or from 140° C. to 160° C. and/or at a pressure in the range from 10 to 70 N/mm, more preferably from 20 to 60 N/mm, and most preferably from 25 to 55 N/mm, for example about 30 N/mm or about 50 N/mm.

In a third aspect, the present invention relates to the use of a surface-treated calcium carbonate-containing filler material for the manufacture of a nonwoven fabric comprising a polylactic acid polymer, wherein the surface-treated calcium carbonate-containing filler material comprises a calcium carbonate-containing filler material and a surface-treatment layer on at least a part of the surface of said calcium carbonate-containing filler material, wherein the surface-treatment layer is formed by contacting the calcium carbonate-containing filler material with a surface treatment agent, and wherein the surface treatment agent comprises at least one mono-substituted succinic anhydride and/or mono-substituted succinic acid and/or a salt thereof.

The inventors surprisingly found that the surface-treated calcium carbonate-containing filler material as defined herein, when used for the manufacture of a nonwoven fabric, inter alia increases the surface roughness of the fibers of the nonwoven fabric. The nonwoven fabric consequently has desirable haptic properties, i.e., a natural "cotton feel", while the mechanical properties of the nonwoven fabric are essentially retained or improved. The use according to the third aspect of the present invention also allows for a more stable spinning process of the polylactic acid polymer fibers even at increased line speeds, a reduction of the static electricity build-up during the spinning process, and a "non-stick" effect on heated rolls, such as engraved rolls used during the calendering process.

In one embodiment of the third aspect of the present invention, the calcium carbonate-containing filler material has prior to the surface treatment i) a weight median particle size ($d_{50}$) value in the range from 0.1 μm to 7 μm, ii) a top cut ($d_{98}$) value of 15 μm or less, iii) a specific surface area (BET) from 0.5 to 120 $m^2/g$, as measured by the BET method, and/or iv) a residual total moisture content from 0.01 wt.-% to 1 wt.-%, based on the total dry weight of the at least one calcium carbonate-containing filler material.

Additionally or alternatively, the surface-treatment layer is formed by contacting the calcium carbonate-containing filler material with a surface treatment agent in an amount from 0.1 to 3.0 wt.-%, preferably 0.1 to 2.5 wt.-%, more preferably 0.1 to 2.0 wt.-%, and most preferably 0.2 to 1.0 wt.-%, based on the total dry weight of the calcium carbonate-containing filler material. The nonwoven fabric may be formed by a process comprising a calendering or hydroentanglement step.

According to the present invention, the nonwoven fabric may comprise from 5 to 25 wt.-%, preferably from 5 to 15 wt.-% of the surface-treated calcium carbonate-containing filler material.

In one embodiment, the polylactic acid polymer has a melt flow rate MFR (210° C./2.16 kg) in the range from 10 to 40 g/10 min, as measured according to EN ISO 1133:2011.

In yet another embodiment, the nonwoven fabric is formed from fibers, which are filaments having

- an average fiber diameter in the range from 9 to 25 μm, preferably from 12 to 21 μm, and/or
- a titer in the range from 1 to 6 dtex, preferably 1.5 to 4 dtex, as measured by EN ISO 2062:2009, and/or are formed from a mixture comprising the surface-treated calcium carbonate-containing filler material and the polylactic acid polymer by spunbonding, wherein preferably the mixture is extruded at a temperature from 210° C. to 250° C., preferably from 215 to 235° C., and most preferably from 220° C. to 225° C.

Alternatively, the fibers may also be staple fibers having

- an average fiber diameter in the range from 9 to 25 μm, preferably from 12 to 21 μm, and/or
- a titer in the range from 1 to 6 dtex, preferably 1.5 to 4 dtex, as measured by EN ISO 2062:2009 and/or
- a staple fiber length in the range from 30 to 90 mm, preferably 40 to 60 mm, wherein the staple fibers are preferably formed from the mixture by a process comprising the steps of multifilament or monofilament extrusion, cutting, and preferably carding.

According to the present invention, the non-woven fabric may be formed by hydroentanglement and preferably the pre-bonding step is performed at a water pressure of about 50 to 120 bar, preferably 60 to 110 bar, more preferably 65 to 105 bar, and/or the water pressure does not exceed 250 bar, preferably 225 bar, more preferably 200 bar and/or the water pressure of the final bonding step is in the range of 90 to 250 bar, preferably 95 to 225 bar, more preferably 100 to 200 bar, and/or at least 95%, preferably at least 98%, more preferably at least 99% of the process water is reused, and/or the nonwoven fabric is dried after the final bonding step at a temperature below 135° C., more preferably below 120° C., even more preferably below 100° C.

The non-woven fabric may also be formed by calendering. Preferably, calendering is performed at a temperature in the range from 120 to 160° C., preferably from 130 to 150° C., or from 140° C. to 160° C. and/or at a pressure in the range from 10 to 70 N/mm, more preferably from 20 to 60 N/mm, and most preferably from 25 to 55 N/mm, for example about 30 N/mm or about 50 N/mm.

A fourth aspect of the present invention relates to an article comprising the inventive nonwoven fabric and/or the nonwoven fabric as obtained in the inventive process. In an exemplary embodiment, the article is selected from the group comprising hygiene products, medical and healthcare products, filter products, geotextile products, agriculture and horticulture products, clothing, footwear and baggage products, household and industrial products, packaging products, construction products and the like.

BRIEF DESCRIPTION OF THE DRAWINGS

FIG. 1 is a schematic diagram of the hydroentanglement step; and

FIG. 2 is schematic diagram of the calendering step.

Advantageous embodiments are defined in the corresponding dependent claims and the exemplary embodiments as follows.

It should be understood that for the purposes of the present invention, the following terms have the following meanings.

The term "surface-treated calcium carbonate-containing filler material" in the meaning of the present invention refers to a material, which has been contacted with a surface-treatment agent such as to obtain a coating layer on at least a part of the surface of the calcium carbonate-containing filler material, wherein the calcium carbonate-containing filler material comprises at least 80 wt.-% calcium carbonate, based on the total dry weight of the surface-treated calcium carbonate-containing filler material.

The term "ground natural calcium carbonate" (GNCC) as used herein refers to a particulate material obtained from natural calcium carbonate-containing minerals, such as chalk, limestone, marble or dolomite, or from organic sources, such as eggshells or seashells, which has been processed in a wet and/or dry comminution step, such as crushing and/or grinding, and optionally has been subjected to further steps such as screening and/or fractionation, for example, by a cyclone or a classifier.

A "precipitated calcium carbonate" (PCC) in the meaning of the present invention is a synthesized material, obtained by precipitation following a reaction of carbon dioxide and calcium hydroxide (hydrated lime) in an aqueous environment. Alternatively, precipitated calcium carbonate can also be obtained by reacting calcium- and carbonate salts, for example calcium chloride and sodium carbonate, in an aqueous environment. PCC may have a vateritic, calcitic or aragonitic crystalline form. PCCs are described, for example, in EP 2 447 213 A1, EP 2 524 898 A1, EP 2 371 766 A1, EP 2 840 065 A1, or WO 2013/142473 A1.

The "particle size" of the calcium carbonate-containing materials herein is described by its weight distribution of particle sizes $d_x$. Therein, the value $d_x$ represents the diameter relative to which x % by weight of the particles have diameters less than $d_x$. This means that, for example, the $d_{20}$ value is the particle size at which 20 wt.-% of all particles are smaller than that particle size. The $d_{50}$ value is thus the weight median particle size, i.e. 50 wt.-% of all particles are smaller than that particle size and the $d_{98}$ value, referred to as top cut, is the particle size at which 98 wt.-% of all particles are smaller than that particle size. The weight median particle size $d_{50}$ and top cut $d_{98}$ are measured by the sedimentation method, which is an analysis of sedimentation behaviour in a gravimetric field. The measurement is made with a Sedigraph™ 5120 of Micromeritics Instrument Corporation, USA. The method and the instrument are known to the skilled person and are commonly used to determine particle size distributions.

Throughout the present document, the term "specific surface area" (in $m^2/g$), which is used to define calcium carbonate or other materials, refers to the specific surface area as determined by using the BET method (using nitrogen as adsorbing gas), as measured according to ISO 9277:2010.

For the purpose of the present application, the "volatile onset temperature" is defined as the temperature at which volatiles—including volatiles introduced as a result of common mineral filler preparation steps including grinding, with or without grinding aid agents, beneficiation, with or without flotation aid or other agents, and other pre-treatment agents not expressly listed above, detected according to the thermogravimetric analysis described hereafter—begin to evolve, as observed on a thermogravimetric (TGA) curve, plotting the mass of remaining sample (y-axis) as a function of temperature (x-axis), the preparation and interpretation of such a curve being defined hereafter.

TGA analytical methods provide information regarding losses of mass and volatile onset temperatures with great accuracy, and is common knowledge; it is, for example, described in "Principles of Instrumental analysis", fifth edition, Skoog, Holler, Nieman, 1998 (first edition 1992) in Chapter 31 pages 798 to 800, and in many other commonly known reference works. The thermogravimetric analysis (TGA) may be performed using a Mettler Toledo TGA 851 based on a sample of 50+/−50 mg and scanning temperatures from 25 to 280° C. or 25 to 400° C. at a rate of 20° C./minute under an air flow of 70 ml/min. The skilled man will be able to determine the "volatile onset temperature" by analysis of the TGA curve as follows: the first derivative of the TGA curve is obtained and the inflection points thereon between 150 and 280° C. or 25 to 400° C. are identified. Of the inflection points having a tangential slope value of greater than 45° relative to a horizontal line, the one having the lowest associated temperature above 200° C. is identified. The temperature value associated with this lowest temperature inflection point of the first derivative curve is the "volatile onset temperature". The total weight of the surface treatment agent on the accessible surface area of the filler can be determined by thermogravimetric analysis by mass loss between 105° C. to 400° C.

For the purpose of the present application, the "total volatiles" associated with mineral fillers and evolved over a temperature range of 25 to 280° C. or 25 to 400° C. is characterised according to % mass loss of the mineral filler sample over a temperature range as read on a thermogravimetric (TGA) curve. The "total volatiles" evolved on the TGA curve can be determined using Star® SW 9.01 software. Using this software, the curve is first normalised relative to the original sample weight in order to obtain mass losses in % values relative to the original sample. Thereafter, the temperature range of 25 to 280° C. or 25 to 400° C. is selected and the step horizontal (in German: "Stufe horizontal") option selected in order to obtain the % mass loss over the selected temperature range.

Unless indicated otherwise, the "residual total moisture content" of a material refers to the percentage of moisture (i.e. water) which may be desorbed from a sample upon heating to 220° C. The "residual total moisture contents" is determined according to the Coulometric Karl Fischer measurement method, wherein the filler material is heated to 220° C., and the water content released as vapor and isolated using a stream of nitrogen gas (at 100 ml/min) is determined in a Coulometric Karl Fischer unit (e.g. Mettler-Toledo coulometric KF Titrator C30, combined with Mettler-Toledo oven DO 0337).

The term "moisture pick-up susceptibility" in the meaning of the present invention refers to the amount of moisture adsorbed on the surface of the powder material or surface-treated filler material product and can be determined in mg moisture/g of the dry powder material or surface-treated filler material product after exposure to an atmosphere of 10 and 85% of relative humidity, resp., for 2.5 hours at a temperature of +23° C. (±2° C.).

The term "dry weight of the calcium carbonate-containing filler material" is understood to describe a filler material having less than 0.3% by weight of water relative to the filler material weight. The % water (equal to residual total moisture content) is determined as described herein.

The term "succinic anhydride", also called dihydro-2,5-furandione, succinic acid anhydride or succinyl oxide, has the molecular formula $C_4H_4O_3$ and is the acid anhydride of succinic acid (1,4-butanedioic acid). The term "mono-substituted" succinic anhydride in the meaning of the present invention refers to a succinic anhydride substituted with one substituent. The term "mono-substituted" succinic acid in the meaning of the present invention refers to a succinic acid substituted with one substituent.

The terms "alkyl" and "aliphatic" in the meaning of the present invention refers to a linear or branched, saturated organic compound composed of carbon and hydrogen. For example, "alkyl succinic acids" are composed of linear or branched, saturated hydrocarbon chains containing a pendant succinic acid group.

The term "alkenyl" in the meaning of the present invention refers to a linear or branched, unsaturated organic compound composed of carbon and hydrogen. Said organic compound further contains at least one double bond in the substituent, preferably one double bond. In other words, "alkenyl succinic acids" are composed of linear or branched, unsaturated hydrocarbon chains containing a pendant succinic acid group. It is appreciated that the term "alkenyl" in the meaning of the present invention includes the cis and trans isomers.

The term "salty reaction products" in the meaning of the present invention refers to products obtained by contacting a calcium carbonate-containing filler material with one or more mono-substituted succinic anhydride and/or mono-substituted succinic acid and/or a salt thereof. Said salty reaction products may be formed between e.g. the mono-substituted succinic anhydride and reactive moieties located at the surface of the calcium carbonate-containing filler material.

As used herein, the term "polymer" generally includes homopolymers and co-polymers such as, for example, block, graft, random and alternating copolymers, as well as blends and modifications thereof. The polymer can be an amorphous polymer, a crystalline polymer, or a semi-crystalline polymer, i.e. a polymer comprising crystalline and amorphous fractions. The degree of crystallinity is specified in percent and can be determined by differential scanning calorimetry (DSC). An amorphous polymer may be characterized by its glass transition temperature and a crystalline polymer may be characterized by its melting point. A semi-crystalline polymer may be characterized by its glass transition temperature and/or its melting point.

For the purposes of the present invention, a "polylactic acid polymer" is a biodegradable, preferably biobased polyester which is derived from the hypothetical polycondensation reaction of lactic acid, also commonly referred to as poly(2-hydroxypropionic acid). It is to be understood that the term includes polylactic acid (CAS No. 26100-51-6) and polylactide (CAS-No. 26680-10-4), which may be formed by condensation of polylactic acid, polylactic acid esters, such as methyl lactate or ethyl lactate, or lactide, i.e., the cyclic dimer of lactic acid. Although lactic acid is a chiral molecule, the present invention is not limited to any specific configuration and includes polymers derived from L-lactic acid, R-lactic acid, and mixtures, in particular racemates, thereof. Thus, the polylactic acid polymer may be selected from the group comprising poly-L-lactide (PLLA), poly-D-lactide (PDLA), poly-D,L-lactide (PDLLA), L-lactic acid (PLLA), poly-D-lactic acid (PDLA) and poly-D,L-lactic acid (PDLLA). Furthermore, copolymers derived from lactic acid monomers and comonomers other than lactic acid are also understood as "polylactic acid polymers" in the sense of the present invention.

The term "biodegradable" within the meaning of the present invention relates to a substance or object capable of being broken down or decomposed with the help of bacteria or other living organisms.

For the purposes of the present invention, the term "biobased" material is defined in accordance with European Standard EN 16575:2014 and relates to a material derived from biomass, i.e., a material of biological origin excluding material embedded in geological formations and/or fossilized material. In the manufacture of the biobased material, the biomass may have undergone physical, chemical or biological treatments.

The term "melt flow rate" (MFR) or "melt index" as used herein refers to the mass of the polymer, given in g/10 min, which is discharged through a defined die under specified temperature and pressure conditions. For polylactic acid polymers, the MFR can be measured under a load of 2.16 kg at 210° C., according to EN ISO 1133:2011 or, alternatively, ASTM D1238-13. The MFR is a measure of the viscosity of the polymer, which is mainly influenced by the molecular weight of the polymer, but also by the degree of branching or the polydispersity.

The expression "polydispersity index" ($M_w/M_n$) as used herein is a measure of the molecular mass distribution and refers to the ratio of the weight-average molar mass and the number-average molar mass of the polymers as determined by gel permeation chromatography (GPC), e.g., according to EN ISO 16014-1:2019.

The term "masterbatch" refers to a composition having a concentration of the surface treated calcium carbonate-containing filler material that is higher than the concentration of the polymer composition used for preparing the fibers and/or filaments and/or nonwoven fabric. That is to say, the masterbatch is further diluted, e.g., during step e) of the present invention, such as to obtain a polymer composition which is suitable for preparing the nonwoven fabric.

For the purposes of the present invention, the term "fibers" may refer both to "staple fibers" and to "filaments".

The term "staple fiber" in the meaning of the present invention refers to a linear structure forming textile fabrics such as nonwovens which typically consist of fiber webs bonded together by e.g. mechanical methods. Accordingly, the term "staple fiber" is understood to refer to a finite structure.

The term "filament" in the meaning of the present invention refers to a structure that differs from staple fibers by its structure length. Accordingly, the term "filament" is understood to refer to endless fibers. It is further appreciated that the filament may be constructed as mono-, bi- or multi-filament. If a bi- or multi-filament is present, the composition of the single filaments may be substantially the same. That is to say, the compositions of the single filaments comprise substantially the same components, in the same amounts. Alternatively, the composition of the single filaments may be different. That is to say, the compositions of the single filaments may comprise the same components in varying amounts or the compositions of the single filaments may comprise different components in the same amounts.

For the purposes of the present invention, the "titer" of a fiber is a measure of the linear mass density, wherein the linear mass density is given by the density of the polymer and, if present, by the density and concentration of the filler in the fiber. The titer represents an average value of the mass of a single fiber strand per unit of length of the single fiber strand. The unit dtex (decitex) is given in grams per 10 000 meters of fiber.

For the purposes of the present invention, the term "fiber diameter" or "fiber thickness" refers to the thickness of a single fiber orthogonal to the fiber direction, as determined by visible light microscopy, or by calculation using the following equation (i), according to Hans J. Koslowski, Dictionary of Man-Made fibers, $2^{nd}$ Edition, 2010, Deutscher Fachverlag, page 279.

$$\text{fiber diameter } (\mu m) = 11.3\sqrt{\left(\frac{T(dtex)}{\text{density}}\right)} \quad \text{(i)}$$

For the purposes of the present invention, the term "staple length" refers to the average length of the staple fibers. The staple length is determined by the distance between the knives during the cutting process of the filaments into fibers.

The terms "fiber formation", "fiber spinning", "fiber extrusion", "filament extrusion" and the like are used interchangeably herein.

Whenever the terms "including" or "having" are used, these terms are meant to be equivalent to "comprising" as defined above.

Where an indefinite or definite article is used when referring to a singular noun, e.g. "a", "an" or "the", this includes a plural of that noun unless something else is specifically stated.

Terms like "obtainable" or "definable" and "obtained" or "defined" are used interchangeably. This e.g. means that, unless the context clearly dictates otherwise, the term "obtained" does not mean to indicate that, e.g., an embodiment must be obtained by, e.g., the sequence of steps following the term "obtained" even though such a limited understanding is always included by the terms "obtained" or "defined" as a preferred embodiment.

In the following, details and preferred embodiments of the inventive process, the inventive nonwoven fabric, the inventive use of the surface-treated calcium carbonate-containing filler material, and articles comprising said inventive nonwoven fabric will be set out in more detail. It is to be understood that the technical details and embodiments, which are described for any one of the aspects of the present invention, also apply to each of the remaining aspects of the invention (as far as applicable).

The Surface-Treated Calcium Carbonate-Containing Filler Material

The inventive process, the inventive product, the inventive use, and the inventive article make use of a surface-treated calcium carbonate-containing filler material. For the purposes of the present invention, the surface-treated calcium carbonate-containing filler material prior to the surface treatment step will be denoted as the "calcium carbonate-containing filler material". Accordingly, the surface-treated calcium carbonate-containing filler material is formed by contacting the calcium carbonate-containing filler material with a surface treatment agent and wherein the surface treatment agent comprises at least one mono-substituted succinic anhydride and/or mono-substituted succinic acid and/or a salt thereof.

The Calcium Carbonate-Containing Filler Material

The calcium carbonate-containing filler material in the meaning of the present invention refers to a material selected from the group consisting of ground natural calcium carbonate (GNCC), precipitated calcium carbonate (PCC) and mixtures thereof.

Preferably, the calcium carbonate-containing filler material is a GNCC.

According to one embodiment of the present invention, the amount of calcium carbonate in the calcium carbonate-comprising filler material is at least 80 wt.-%, e.g. at least 95 wt.-%, preferably between 97 and 100 wt.-%, more preferably between 98.5 and most preferably 99.95 wt.-%, based on the total dry weight of the calcium carbonate-comprising filler material.

The at least one calcium carbonate-comprising filler material is in the form of a particulate material, and has a particle size distribution suitable for the production of the nonwoven fabric according to the invention. Thus, the calcium carbonate-comprising filler material preferably has a weight median particle size $d_{50}$ from 0.1 μm to 7 μm, more preferably from 0.25 μm to 5 μm, even more preferably from 0.5 μm to 4 μm, and most preferably from 1.0 to 3.5 μm.

Accordingly, the calcium carbonate-comprising filler material preferably has a top cut ($d_{98}$) of ≤15 μm, more preferably of ≤12.5 μm, even more preferably of ≤10 μm, and most preferably of ≤7.5 μm. It is understood that the top cut of the material may be selected such that fiber formation step f) can be performed essentially without disturbance, e.g., without large calcium-carbonate particles clogging the dies and/or the holes of the spinneret.

Furthermore, the calcium carbonate-comprising filler material preferably has a BET specific surface area of from 0.5 and 150 $m^2/g$, more preferably from 0.5 to 50 $m^2/g$, even more preferably from 0.5 to 35 $m^2/g$, and most preferably from 0.5 to 15 $m^2/g$, as measured using nitrogen and the BET method according to ISO 9277:2010.

According to one embodiment of the present invention, the calcium carbonate-comprising filler material has a weight median particle size $d_{50}$ from 0.1 μm to 7 μm and/or a top cut ($d_{98}$) of 15 μm and/or a specific surface area (BET) of from 0.5 to 120 $m^2/g$, as measured using nitrogen and the BET method according to ISO 9277:2010.

In one embodiment of the present invention, the calcium carbonate-comprising filler material is preferably a marble having a median particle size diameter $d_{50}$ value from 0.1 μm to 7 μm, preferably from 0.25 μm to 5 μm, more preferably from 0.5 to 4 μm, and most preferably from 1.0 μm to 3.5 μm. In this case, the at least one calcium carbonate-comprising filler material may exhibit a BET specific surface area of from 0.5 to 150 $m^2/g$, preferably of from 0.5 to 50 $m^2/g$, more preferably of from 0.5 to 35 $m^2/g$ and most preferably of from 0.5 to 15 $m^2/g$, measured using nitrogen and the BET method according to ISO 9277:2010.

For example, the calcium carbonate-comprising filler material may have a median particle size diameter $d_{50}$ value from 0.25 μm to 5 μm, preferably from 0.5 to 4 μm, more preferably from 1.0 μm to 3.5 μm, a top cut ($d_{98}$) of ≤10 μm, more preferably of ≤7.5 μm, and a BET specific surface area of from 0.5 to 50 $m^2/g$, preferably of from 0.5 to 35 $m^2/g$ and most preferably of from 0.5 to 15 $m^2/g$, measured using nitrogen and the BET method according to ISO 9277:2010.

It is preferred that the calcium carbonate-comprising filler material is a dry ground material, a material being wet ground and dried or a mixture of the foregoing materials. In general, the grinding step can be carried out with any conventional grinding device, for example, under conditions such that refinement predominantly results from impacts with a secondary body, i.e., in one or more of a ball mill, a rod mill, a vibrating mill, a roll crusher, a centrifugal impact mill, a vertical bead mill an attrition mill, a pin mill, a hammer mill, a pulveriser, a shredder, a de-clumper, a knife cutter, or other such equipment known to the skilled man.

In case the calcium carbonate-comprising filler material is a wet ground calcium carbonate-comprising filler material, the grinding step may be performed under conditions such that autogenous grinding takes place and/or by horizontal ball milling, and/or other such processes known to the skilled man. It is to be noted that the same grinding methods can be used for dry grinding the calcium carbonate-comprising filler material. The wet processed ground calcium carbonate-comprising filler material thus obtained may be washed and dewatered by well-known processes, e.g. by flocculation, filtration or forced evaporation prior to drying. The subsequent step of drying may be carried out in a single step such as spray drying, or in at least two steps, e.g. by applying a first heating step to the calcium carbonate-comprising filler material in order to reduce the associated moisture content to a level which is not greater than about 0.5 wt.-%, based on the total dry weight of the calcium carbonate-comprising filler material. The residual total moisture content of the filler can be measured by the Karl Fischer coulometric titration method, desorbing the moisture in an oven at 195° C. and passing it continuously into the KF coulometer (Mettler Toledo coulometric KF Titrator C30, combined with Mettler oven DO 0337) using dry $N_2$ at 100 ml/min, e.g. for 10 min. The residual total moisture content may be further reduced by applying a second heating step to the calcium carbonate-comprising filler material. In case said drying is carried out by more than one drying steps, the first step may be carried out by heating in a hot current of air, while the second and further drying steps are preferably carried out by an indirect heating in which the atmosphere in the corresponding vessel comprises a surface treatment agent. It is also common that the calcium carbonate-comprising filler material is subjected to a beneficiation step (such as a flotation, bleaching or magnetic separation step) to remove impurities.

In one embodiment of the present invention, the calcium carbonate-comprising filler material comprises a dry ground calcium carbonate-comprising filler material. In another preferred embodiment, the calcium carbonate-comprising filler material is a material being wet ground in a horizontal ball mill, and subsequently dried by using the well-known process of spray drying.

According to the present invention the calcium carbonate-comprising filler material preferably has a residual moisture content of from 0.01 to 1 wt.-%, based on the total dry weight of the calcium carbonate-comprising filler material. Depending on the calcium carbonate-comprising filler material, the calcium carbonate-comprising filler material may have a residual total moisture content of from 0.01 to 0.2 wt.-%, preferably from 0.02 to 0.15 wt.-% and most preferably from 0.04 to 0.15 wt.-%, based on the total dry weight of the calcium carbonate-comprising filler material.

For example, in case a wet ground and spray dried marble is used as calcium carbonate-comprising filler material, the residual total moisture content of the calcium carbonate-comprising filler material is preferably from 0.01 to 0.1 wt.-%, more preferably from 0.02 to 0.08 wt.-%, and most preferably from 0.04 to 0.07 wt.-%, based on the total dry weight of the calcium carbonate-comprising filler material. If a PCC is used as calcium carbonate-comprising filler material, the residual total moisture content of the calcium carbonate-comprising filler material is preferably of from 0.01 to 0.2 wt.-%, more preferably from 0.05 to 0.17 wt.-%, and most preferably from 0.05 to 0.10 wt.-%, based on the total dry weight of the calcium carbonate-comprising filler material.

The Surface Treatment Layer

According to the present invention, the surface-treated calcium carbonate-containing filler material further comprises a surface-treatment layer on at least a part of the surface of the calcium carbonate-containing filler material, wherein the treatment layer is formed by contacting the calcium carbonate-containing filler material with a surface-treatment agent, wherein the surface treatment agent comprises at least one mono-substituted succinic anhydride and/or mono-substituted succinic acid and/or a salt thereof.

According to a preferred embodiment, the surface-treated calcium carbonate-containing filler material is formed by contacting the calcium carbonate-containing filler material with a surface-treatment agent in an amount from 0.1 to 3.0 wt.-%, preferably in an amount from 0.1 to 2.5 wt.-%, more preferably in an amount from 0.1 to 2 wt.-%, still more preferably in an amount from 0.1 to 1.5 wt.-%, even more preferably in an amount from 0.2 to 1 wt.-%, and most preferably in an amount from 0.2 to 0.8 wt.-%, based on the total dry weight of the calcium carbonate-containing filler material.

The surface-treated calcium carbonate-containing filler material according to the present invention has excellent surface characteristics. For example, the surface-treated calcium carbonate-containing filler material may have a high volatile onset temperature, for example ≥250° C., preferably of ≥260° C., and most preferably of ≥270° C., and a high thermal stability, e.g. up to temperatures of 250° C., 270° C., or 290° C. Additionally or alternatively, the surface-treated calcium carbonate-containing filler material may have total volatiles between 25° C. and 350° C. of less than 0.25%, and preferably of less than 0.23% by mass, e.g., of from 0.04 to 0.21% by mass, preferably from 0.08 to 0.15% by mass, more preferably from 0.1 to 0.12% by mass. Furthermore, the surface-treated calcium carbonate-containing filler material may feature a low moisture pick-up susceptibility, characterized by its total surface moisture level of less than 1 mg/g of dry calcium carbonate-comprising filler material, at a temperature of about +23° C. (±2° C.). For example, the surface-treated calcium carbonate-containing filler material has a moisture pick-up susceptibility from 0.1 to 1 mg/g, more preferably from 0.2 to 0.9 mg/g; and most preferably of from 0.2 to 0.8 mg/g of dry calcium carbonate-comprising material at a temperature of +23° C. (±2° C.). Additionally or alternatively, the surface-treated calcium carbonate-containing filler material may have a hydrophilicity of below 8:2 volumetric ratio of water:ethanol measured at +23° C. (±2° C.) with the sedimentation method, for example, of below 7:3 volumetric ratio of water:ethanol measured at +23° C. (±2° C.) with the sedimentation method.

The Surface Treatment Agent

According to one embodiment of the present invention, the surface treatment agent comprises at least one mono-substituted succinic anhydride and/or mono-substituted succinic acid and/or a salt thereof.

It is appreciated that the expression "at least one" mono-substituted succinic anhydride and/or mono-substituted succinic acid and/or a salt thereof means that one or more kinds of mono-substituted succinic anhydride and/or mono-substituted succinic acid and/or a salt thereof may be provided in any aspect of the present invention.

According to a preferred embodiment of the present invention, the surface treatment agent comprises at least one mono-substituted succinic anhydride.

It is appreciated that the expression "at least one" mono-substituted succinic anhydride means that one or more kinds of mono-substituted succinic anhydride may be provided in any aspect of the present invention.

Accordingly, it should be noted that the at least one mono-substituted succinic anhydride may be one kind of mono-substituted succinic anhydride. Alternatively, the at least one mono-substituted succinic anhydride may be a mixture of two or more kinds of mono-substituted succinic anhydride. For example, the at least one mono-substituted succinic anhydride may be a mixture of two or three kinds of mono-substituted succinic anhydride, like two kinds of mono-substituted succinic anhydride.

In one embodiment of the present invention, the at least one mono-substituted succinic anhydride is one kind of mono-substituted succinic anhydride.

It is appreciated that the at least one mono-substituted succinic anhydride represents a surface treatment agent and consists of succinic anhydride mono-substituted with a group selected from any linear, branched, aliphatic, and cyclic group having a total amount of carbon atoms from C2 to C30 in the substituent. The at least one mono-substituted succinic anhydride and/or mono-substituted succinic acid and/or a salt thereof may be mono-substituted with a group selected from any linear, branched, aliphatic and cyclic group having a total amount of carbons from C2 to C30 in the substituent, preferably wherein the group is a linear and aliphatic group having a total amount of carbon atoms from C2 to C30, or a branched and aliphatic group having a total amount of carbon atoms from C2 to C30, or a linear or branched alkenyl group having a total amount of carbon atoms from C2 to C30.

In one embodiment of the present invention, the at least one mono-substituted succinic anhydride consists of succinic anhydride mono-substituted with a group selected from a linear, branched, aliphatic, and cyclic group having a total amount of carbon atoms from C3 to C20 in the substituent. For example, the at least one mono-substituted succinic anhydride consists of succinic anhydride mono-substituted with a group selected from a linear, branched, aliphatic, and cyclic group having a total amount of carbon atoms from C4 to C18 in the substituent.

In one embodiment of the present invention, the at least one mono-substituted succinic anhydride consists of succinic anhydride mono-substituted with one group being a linear and aliphatic group having a total amount of carbon atoms from C2 to C30, preferably from C3 to C20 and most preferably from C4 to C18 in the substituent. Additionally or alternatively, the at least one mono-substituted succinic anhydride consists of succinic anhydride mono-substituted with one group being a branched and aliphatic group having a total amount of carbon atoms from C2 to C30, preferably from C3 to C20 and most preferably from C4 to C18 in the substituent.

Thus, it is preferred that the at least one mono-substituted succinic anhydride consists of succinic anhydride mono-substituted with one group being a linear or branched, alkyl group having a total amount of carbon atoms from C2 to C30, preferably from C3 to C20 and most preferably from C4 to C18 in the substituent.

For example, the at least one mono-substituted succinic anhydride consists of succinic anhydride mono-substituted with one group being a linear alkyl group having a total amount of carbon atoms from C2 to C30, preferably from C3 to C20 and most preferably from C4 to C18 in the substituent. Additionally or alternatively, the at least one mono-substituted succinic anhydride consists of succinic anhydride mono-substituted with one group being a branched alkyl group having a total amount of carbon atoms from C2 to C30, preferably from C3 to C20 and most preferably from C4 to C18 in the substituent.

In one embodiment of the present invention, the at least one mono-substituted succinic anhydride is at least one linear or branched alkyl mono-substituted succinic anhydride. For example, the at least one alkyl mono-substituted succinic anhydride is selected from the group comprising ethylsuccinic anhydride, propylsuccinic anhydride, butylsuccinic anhydride, triisobutyl succinic anhydride, pentylsuccinic anhydride, hexylsuccinic anhydride, heptylsuccinic anhydride, octylsuccinic anhydride, nonylsuccinic anhydride, decyl succinic anhydride, dodecyl succinic anhydride, hexadecanyl succinic anhydride, octadecanyl succinic anhydride, and mixtures thereof.

Accordingly, it is appreciated that, e.g., the term "butylsuccinic anhydride" comprises linear and branched butylsuccinic anhydride(s). One specific example of linear butylsuccinic anhydride(s) is n-butylsuccinic anhydride. Specific examples of branched butylsuccinic anhydride(s) are iso-butylsuccinic anhydride, sec-butylsuccinic anhydride and/or tert-butylsuccinic anhydride.

Furthermore, it is appreciated that, e.g., the term "hexadecanyl succinic anhydride" comprises linear and branched hexadecanyl succinic anhydride(s). One specific example of linear hexadecanyl succinic anhydride(s) is n-hexadecanyl succinic anhydride. Specific examples of branched hexadecanyl succinic anhydride(s) are 14-methylpentadecanyl succinic anhydride, 13-methylpentadecanyl succinic anhydride, 12-methylpentadecanyl succinic anhydride, 11-methylpentadecanyl succinic anhydride, 10-methylpentadecanyl succinic anhydride, 9-methylpentadecanyl succinic anhydride, 8-methylpentadecanyl succinic anhydride, 7-methylpentadecanyl succinic anhydride, 6-methylpentadecanyl succinic anhydride, 5-methylpentadecanyl succinic anhydride, 4-methylpentadecanyl succinic anhydride, 3-methylpentadecanyl succinic anhydride, 2-methylpentadecanyl succinic anhydride, 1-methylpentadecanyl succinic anhydride, 13-ethylbutadecanyl succinic anhydride, 12-ethylbutadecanyl succinic anhydride, 11-ethylbutadecanyl succinic anhydride, 10-ethylbutadecanyl succinic anhydride, 9-ethylbutadecanyl succinic anhydride, 8-ethylbutadecanyl succinic anhydride, 7-ethylbutadecanyl succinic anhydride, 6-ethylbutadecanyl succinic anhydride, 5-ethylbutadecanyl succinic anhydride, 4-ethylbutadecanyl succinic anhydride, 3-ethylbutadecanyl succinic anhydride, 2-ethylbutadecanyl succinic anhydride, 1-ethylbutadecanyl succinic anhydride, 2-butyldodecanyl succinic anhydride, 1-hexyldecanyl succinic anhydride, 1-hexyl-2-decanyl succinic anhydride, 2-hexyldecanyl succinic anhydride, 6,12-dimethylbutadecanyl succinic anhydride, 2,2-diethyldodecanyl succinic anhydride, 4,8,12-trimethyltridecanyl succinic anhydride, 2,2,4,6,8-pentamethylundecanyl succinic anhydride, 2-ethyl-4-methyl-2-(2-methylpentyl)-heptyl succinic anhydride and/or 2-ethyl-4,6-dimethyl-2-propylnonyl succinic anhydride.

Furthermore, it is appreciated that e.g. the term "octadecanyl succinic anhydride" comprises linear and branched octadecanyl succinic anhydride(s). One specific example of linear octadecanyl succinic anhydride(s) is n-octadecanyl succinic anhydride. Specific examples of branched hexadecanyl succinic anhydride(s) are 16-methylheptadecanyl succinic anhydride, 15-methylheptadecanyl succinic anhydride, 14-methylheptadecanyl succinic anhydride, 13-methylheptadecanyl succinic anhydride, 12-methylheptadecanyl succinic anhydride, 11-methylheptadecanyl succinic anhydride, 10-methylheptadecanyl succinic anhydride, 9-methylheptadecanyl succinic anhydride, 8-methylheptadecanyl succinic anhydride, 7-methylheptadecanyl succinic anhydride, 6-methylheptadecanyl succinic anhydride, 5-methylheptadecanyl succinic anhydride, 4-methylheptadecanyl succinic anhydride, 3-methylheptadecanyl succinic anhydride, 2-methylheptadecanyl succinic anhydride, 1-methylheptadecanyl succinic anhydride, 14-ethylhexadecanyl succinic anhydride, 13-ethylhexadecanyl succinic anhydride, 12-ethylhexadecanyl succinic anhydride, 11-ethylhexadecanyl succinic anhydride, 10-ethylhexadecanyl succinic anhydride, 9-ethylhexadecanyl succinic anhydride, 8-ethylhexadecanyl succinic anhydride, 7-ethylhexadecanyl succinic anhydride, 6-ethylhexadecanyl succinic anhydride, 5-ethylhexadecanyl succinic anhydride, 4-ethylhexadecanyl succinic anhydride, 3-ethylhexadecanyl succinic anhydride, 2-ethylhexadecanyl succinic anhydride, 1-ethylhexadecanyl succinic anhydride, 2-hexyldodecanyl succinic anhydride, 2-heptylundecanyl succinic anhydride, iso-octadecanyl succinic anhydride and/or 1-octyl-2-decanyl succinic anhydride.

In one embodiment of the present invention, the at least one alkyl mono-substituted succinic anhydride is selected from the group comprising butylsuccinic anhydride, hexylsuccinic anhydride, heptylsuccinic anhydride, octylsuccinic anhydride, hexadecanyl succinic anhydride, octadecanyl succinic anhydride, and mixtures thereof.

In one embodiment of the present invention, the at least one mono-substituted succinic anhydride is one kind of alkyl mono-substituted succinic anhydride. For example, the one alkyl mono-substituted succinic anhydride is butylsuccinic anhydride. Alternatively, the one alkyl mono-substituted succinic anhydride is hexylsuccinic anhydride. Alternatively, the one alkyl mono-substituted succinic anhydride is heptylsuccinic anhydride or octylsuccinic anhydride. Alternatively, the one alkyl mono-substituted succinic anhydride is hexadecanyl succinic anhydride. For example, the one alkyl mono-substituted succinic anhydride is linear hexadecanyl succinic anhydride such as n-hexadecanyl succinic anhydride or branched hexadecanyl succinic anhydride such as 1-hexyl-2-decanyl succinic anhydride. Alternatively, the one alkyl mono-substituted succinic anhydride is octadecanyl succinic anhydride. For example, the one alkyl mono-substituted succinic anhydride is linear octadecanyl succinic anhydride such as n-octadecanyl succinic anhydride or branched octadecanyl succinic anhydride such as iso-octadecanyl succinic anhydride or 1-octyl-2-decanyl succinic anhydride.

In one embodiment of the present invention, the one alkyl mono-substituted succinic anhydride is butylsuccinic anhydride such as n-butylsuccinic anhydride.

In one embodiment of the present invention, the at least one mono-substituted succinic anhydride is a mixture of two or more kinds of alkyl mono-substituted succinic anhydrides. For example, the at least one mono-substituted succinic anhydride is a mixture of two or three kinds of alkyl mono-substituted succinic anhydrides.

In a preferred embodiment of the present invention, the at least one mono-substituted succinic anhydride consists of succinic anhydride mono-substituted with one group being a linear or branched alkenyl group having a total amount of carbon atoms from C2 to C30, preferably from C3 to C20 and most preferably from C4 to C20 in the substituent.

In one embodiment of the present invention, the at least one mono-substituted succinic anhydride is at least one linear or branched alkenyl mono-substituted succinic anhydride. For example, the at least one alkenyl mono-substituted succinic anhydride is selected from the group comprising ethenylsuccinic anhydride, propenylsuccinic anhydride, butenylsuccinic anhydride, triisobutenyl succinic anhydride, pentenylsuccinic anhydride, hexenylsuccinic anhydride, heptenylsuccinic anhydride, octenylsuccinic anhydride, nonenylsuccinic anhydride, decenyl succinic anhydride, dodecenyl succinic anhydride, hexadecenyl succinic anhydride, octadecenyl succinic anhydride, and mixtures thereof.

Accordingly, it is appreciated that e.g. the term "hexadecenyl succinic anhydride" comprises linear and branched hexadecenyl succinic anhydride(s). One specific example of linear hexadecenyl succinic anhydride(s) is n-hexadecenyl succinic anhydride such as 14-hexadecenyl succinic anhydride, 13-hexadecenyl succinic anhydride, 12-hexadecenyl succinic anhydride, 11-hexadecenyl succinic anhydride, 10-hexadecenyl succinic anhydride, 9-hexadecenyl succinic anhydride, 8-hexadecenyl succinic anhydride, 7-hexadecenyl succinic anhydride, 6-hexadecenyl succinic anhydride, 5-hexadecenyl succinic anhydride, 4-hexadecenyl succinic anhydride, 3-hexadecenyl succinic anhydride and/or 2-hexadecenyl succinic anhydride. Specific examples of branched hexadecenyl succinic anhydride(s) are 14-methyl-9-pentadecenyl succinic anhydride, 14-methyl-2-pentadecenyl succinic anhydride, 1-hexyl-2-decenyl succinic anhydride and/or iso-hexadecenyl succinic anhydride.

Furthermore, it is appreciated that e.g. the term "octadecenyl succinic anhydride" comprises linear and branched octadecenyl succinic anhydride(s). One specific example of linear octadecenyl succinic anhydride(s) is n-octadecenyl succinic anhydride such as 16-octadecenyl succinic anhydride, 15-octadecenyl succinic anhydride, 14-octadecenyl succinic anhydride, 13-octadecenyl succinic anhydride, 12-octadecenyl succinic anhydride, 11-octadecenyl succinic anhydride, 10-octadecenyl succinic anhydride, 9-octadecenyl succinic anhydride, 8-octadecenyl succinic anhydride, 7-octadecenyl succinic anhydride, 6-octadecenyl succinic anhydride, 5-octadecenyl succinic anhydride, 4-octadecenyl succinic anhydride, 3-octadecenyl succinic anhydride and/or 2-octadecenyl succinic anhydride. Specific examples of branched octadecenyl succinic anhydride(s) are 16-methyl-9-heptadecenyl succinic anhydride, 16-methyl-7-heptadecenyl succinic anhydride, 1-octyl-2-decenyl succinic anhydride and/or iso-octadecenyl succinic anhydride.

In one embodiment of the present invention, the at least one alkenyl mono-substituted succinic anhydride is selected from the group comprising hexenylsuccinic anhydride, octenylsuccinic anhydride, hexadecenyl succinic anhydride, octadecenyl succinic anhydride, and mixtures thereof.

In one embodiment of the present invention, the at least one mono-substituted succinic anhydride is one alkenyl mono-substituted succinic anhydride. For example, the one alkenyl mono-substituted succinic anhydride is hexenylsuccinic anhydride. Alternatively, the one alkenyl mono-substituted succinic anhydride is octenylsuccinic anhydride. Alternatively, the one alkenyl mono-substituted succinic anhydride is hexadecenyl succinic anhydride. For example, the one alkenyl mono-substituted succinic anhydride is linear hexadecenyl succinic anhydride such as n-hexadecenyl succinic anhydride or branched hexadecenyl succinic anhydride such as 1-hexyl-2-decenyl succinic anhydride. Alternatively, the one alkenyl mono-substituted succinic anhydride is octadecenyl succinic anhydride. For example, the one alkyl mono-substituted succinic anhydride is linear octadecenyl succinic anhydride such as n-octadecenyl succinic anhydride or branched octadecenyl succinic anhydride such iso-octadecenyl succinic anhydride, or 1-octyl-2-decenyl succinic anhydride.

In one embodiment of the present invention, the one alkenyl mono-substituted succinic anhydride is linear octadecenyl succinic anhydride such as n-octadecenyl succinic anhydride. In another embodiment of the present invention, the one alkenyl mono-substituted succinic anhydride is linear octenylsuccinic anhydride such as n-octenylsuccinic anhydride.

In one embodiment of the present invention, the at least one mono-substituted succinic anhydride is a mixture of two or more kinds of alkenyl mono-substituted succinic anhydrides. For example, the at least one mono-substituted succinic anhydride is a mixture of two or three kinds of alkenyl mono-substituted succinic anhydrides.

If the at least one mono-substituted succinic anhydride is a mixture of two or more kinds of alkenyl mono-substituted succinic anhydrides, one alkenyl mono-substituted succinic anhydride is linear or branched octadecenyl succinic anhydride, while each further alkenyl mono-substituted succinic anhydride is selected from ethenylsuccinic anhydride, propenylsuccinic anhydride, butenylsuccinic anhydride, pentenylsuccinic anhydride, hexenylsuccinic anhydride, heptenylsuccinic anhydride, nonenylsuccinic anhydride, hexadecenyl succinic anhydride and mixtures thereof. For example, the at least one mono-substituted succinic anhydride is a mixture of two or more kinds of alkenyl mono-substituted succinic anhydrides, wherein one alkenyl mono-substituted succinic anhydride is linear octadecenyl succinic anhydride and each further alkenyl mono-substituted succinic anhydride is selected from ethenylsuccinic anhydride, propenylsuccinic anhydride, butenylsuccinic anhydride, pentenylsuccinic anhydride, hexenylsuccinic anhydride, heptenylsuccinic anhydride, nonenylsuccinic anhydride, hexadecenyl succinic anhydride and mixtures thereof. Alternatively, the at least one mono-substituted succinic anhydride is a mixture of two or more kinds of alkenyl mono-substituted succinic anhydrides, wherein one alkenyl mono-substituted succinic anhydride is branched octadecenyl succinic anhydride and each further alkenyl mono-substituted succinic anhydride is selected from ethenylsuccinic anhydride, propenylsuccinic anhydride, butenylsuccinic anhydride, pentenylsuccinic anhydride, hexenylsuccinic anhydride, heptenylsuccinic anhydride, nonenylsuccinic anhydride, hexadecenyl succinic anhydride and mixtures thereof.

For example, the at least one mono-substituted succinic anhydride is a mixture of two or more kinds of alkenyl mono-substituted succinic anhydrides comprising one or more hexadecenyl succinic anhydride, like linear or branched hexadecenyl succinic anhydride(s), and one or more octadecenyl succinic anhydride, like linear or branched octadecenyl succinic anhydride(s).

In one embodiment of the present invention, the at least one mono-substituted succinic anhydride is a mixture of two or more kinds of alkenyl mono-substituted succinic anhydrides comprising linear hexadecenyl succinic anhydride(s) and linear octadecenyl succinic anhydride(s). Alternatively, the at least one mono-substituted succinic anhydride is a mixture of two or more kinds of alkenyl mono-substituted succinic anhydrides comprising branched hexadecenyl succinic anhydride(s) and branched octadecenyl succinic anhydride(s). For example, the one or more hexadecenyl succinic anhydride is linear hexadecenyl succinic anhydride like n-hexadecenyl succinic anhydride and/or branched hexadecenyl succinic anhydride like 1-hexyl-2-decenyl succinic anhydride. Additionally or alternatively, the one or more octadecenyl succinic anhydride is linear octadecenyl succinic anhydride like n-octadecenyl succinic anhydride and/or branched octadecenyl succinic anhydride like iso-octadecenyl succinic anhydride and/or 1-octyl-2-decenyl succinic anhydride.

If the at least one mono-substituted succinic anhydride is a mixture of two or more kinds of alkenyl mono-substituted succinic anhydrides, it is appreciated that one alkenyl mono-substituted succinic anhydride is present in an amount of from 20 to 60 wt.-% and preferably of from 30 to 50 wt.-%, based on the total weight of the at least one mono-substituted succinic anhydride provided.

For example, if the at least one mono-substituted succinic anhydride is a mixture of two or more kinds of alkenyl mono-substituted succinic anhydrides comprising one or more hexadecenyl succinic anhydride(s), like linear or branched hexadecenyl succinic anhydride(s), and one or more octadecenyl succinic anhydride(s), like linear or branched hexadecenyl succinic anhydride(s), it is preferred that the one or more octadecenyl succinic anhydride(s) is present in an amount of from 20 to 60 wt.-% and preferably of from 30 to 50 wt.-%, based on the total weight of the at least one mono-substituted succinic anhydride.

Preferred alkenyl mono-substituted succinic anhydrides include branched hexadecenyl succinic anhydrides (CAS No. 32072-96-1), branched octadecenyl succinic anhydrides (CAS No. 28777-98-2) and 2,5-furandione, dihydro-, mono-$C_{15-20}$-alkenyl derivatives (CAS No. 68784-12-3). According to a preferred embodiment of the present invention the at least one mono-substituted succinic anhydride is 2,5-furandione, dihydro-, mono-$C_{15-20}$-alkenyl derivatives (CAS No. 68784-12-3).

It is also appreciated that the at least one mono-substituted succinic anhydride may be a mixture of at least one alkyl mono-substituted succinic anhydrides and at least one alkenyl mono-substituted succinic anhydrides.

If the at least one mono-substituted succinic anhydride is a mixture of at least one alkyl mono-substituted succinic anhydrides and at least one alkenyl mono-substituted succinic anhydrides, it is appreciated that the alkyl substituent of the at least one alkyl mono-substituted succinic anhydrides and the alkenyl substituent of the at least one alkenyl mono-substituted succinic anhydrides are preferably the same. For example, the at least one mono-substituted succinic anhydride is a mixture of ethylsuccinic anhydride and ethenylsuccinic anhydride. Alternatively, the at least one mono-substituted succinic anhydride is a mixture of propylsuccinic anhydride and propenylsuccinic anhydride. Alternatively, the at least one mono-substituted succinic anhydride is a mixture of butylsuccinic anhydride and butenylsuccinic anhydride. Alternatively, the at least one mono-substituted succinic anhydride is a mixture of triisobutyl succinic anhydride and triisobutenyl succinic anhydride. Alternatively, the at least one mono-substituted succinic anhydride is a mixture of pentylsuccinic anhydride and pentenylsuccinic anhydride. Alternatively, the at least one mono-substituted succinic anhydride is a mixture of hexylsuccinic anhydride and hexenylsuccinic anhydride. Alternatively, the at least one mono-substituted succinic anhydride is a mixture of heptylsuccinic anhydride and heptenylsuccinic anhydride. Alternatively, the at least one mono-substituted succinic anhydride is a mixture of octylsuccinic anhydride and octenylsuccinic anhydride. Alternatively, the at least one mono-substituted succinic anhydride is a mixture of nonylsuccinic anhydride and nonenylsuccinic anhydride. Alternatively, the at least one mono-substituted succinic anhydride is a mixture of decyl succinic anhydride and decenyl succinic anhydride.

Alternatively, the at least one mono-substituted succinic anhydride is a mixture of dodecyl succinic anhydride and dodecenyl succinic anhydride. Alternatively, the at least one mono-substituted succinic anhydride is a mixture of hexadecanyl succinic anhydride and hexadecenyl succinic anhydride. For example, the at least one mono-substituted succinic anhydride is a mixture of linear hexadecanyl succinic anhydride and linear hexadecenyl succinic anhydride or a mixture of branched hexadecanyl succinic anhydride and branched hexadecenyl succinic anhydride. Alternatively, the at least one mono-substituted succinic anhydride is a mixture of octadecanyl succinic anhydride and octadecenyl succinic anhydride. For example, the at least one mono-substituted succinic anhydride is a mixture of linear octadecanyl succinic anhydride and linear octadecenyl succinic anhydride or a mixture of branched octadecanyl succinic anhydride and branched octadecenyl succinic anhydride.

In one embodiment of the present invention, the at least one mono-substituted succinic anhydride is a mixture of nonylsuccinic anhydride and nonenylsuccinic anhydride.

If the at least one mono-substituted succinic anhydride is a mixture of at least one alkyl mono-substituted succinic anhydrides and at least one alkenyl mono-substituted succinic anhydrides, the weight ratio between the at least one alkyl mono-substituted succinic anhydride and the at least one alkenyl mono-substituted succinic anhydride is between 90:10 and 10:90 (wt.-%/wt.-%). For example, the weight ratio between the at least one alkyl mono-substituted succinic anhydride and the at least one alkenyl mono-substituted succinic anhydride is between 70:30 and 30:70 (wt.-%/wt.-%) or between 60:40 and 40:60 (wt.-%/wt.-%).

It is appreciated that the at least one mono-substituted succinic anhydride may be provided in the process of the present invention in combination with at least one mono-substituted succinic acid and/or a salt thereof. Alternatively, the surface treatment agent may comprise at least one mono-substituted succinic acid and/or a salt thereof.

Accordingly, it should be noted that the at least one mono-substituted succinic acid and/or a salt thereof may be one kind of mono-substituted succinic acid and/or a salt thereof. Alternatively, the at least one mono-substituted succinic acid may be a mixture of two or more kinds of mono-substituted succinic acid and/or a salt thereof. For example, the at least one mono-substituted succinic acid and/or a salt thereof may be a mixture of two or three kinds of mono-substituted succinic acids and/or salts thereof, like two kinds of mono-substituted succinic acids and/or salts thereof.

In one embodiment of the present invention, the at least one mono-substituted succinic acid and/or a salt thereof is one kind of mono-substituted succinic acid and/or a salt thereof.

It is appreciated that the at least one mono-substituted succinic acid and/or a salt thereof represents a surface treatment agent and consists of succinic acid and/or its salt mono-substituted with a group selected from any linear, branched, aliphatic and cyclic group having a total amount of carbon atoms from C2 to C30 in the substituent.

In one embodiment of the present invention, the at least one mono-substituted succinic acid and/or a salt thereof consists of succinic acid and/or its salt mono-substituted with a group selected from a linear, branched, aliphatic and cyclic group having a total amount of carbon atoms from C3 to C20 in the substituent. For example, the at least one mono-substituted succinic acid and/or a salt thereof consists of succinic acid and/or its salt mono-substituted with a group selected from a linear, branched, aliphatic and cyclic group having a total amount of carbon atoms from C4 to C18 in the substituent.

It is appreciated that the at least one mono-substituted succinic anhydride and the at least one mono-substituted succinic acid and/or a salt thereof may comprise the same or different substituent.

In one embodiment of the present invention, the succinic acid molecule and/or its salt of the at least one mono-substituted succinic acid and/or a salt thereof and the succinic anhydride molecule of the at least one mono-substituted succinic anhydride are mono-substituted with the same group selected from any linear, branched, aliphatic and cyclic group having a total amount of carbon atoms from C2 to C30, preferably from C3 to C20 and most preferably from C4 to C18 in the substituent.

If the at least one mono-substituted succinic anhydride is provided in combination with at least one mono-substituted succinic acid and/or a salt thereof, the at least one mono-substituted succinic acid is present in an amount of ≤10 mol.-%, based on the molar sum of the at least one mono-substituted succinic anhydride and the at least one mono-substituted succinic acid and/or its salt. For example, the at least one mono-substituted succinic acid is present in an amount of ≤5 mol.-%, preferably of ≤2.5 mol.-% and most preferably of ≤1 mol.-%, based on the molar sum of the at least one mono-substituted succinic anhydride and the at least one mono-substituted succinic acid and/or its salt.

Additionally or alternatively, the at least one mono-substituted succinic acid is provided in a blend together with the at least one mono-substituted succinic anhydride.

In a particularly preferred embodiment, the surface-treatment layer is formed by contacting the calcium carbonate-containing filler material with a mixture of alkenyl succinic anhydrides and/or alkenyl succinic acids, wherein the alkenyl succinic anhydrides and/or alkenyl succinic acids are mono-substituted with a group selected from any linear or branched mono-alkenyl group having a total amount of carbon atoms from C12 to C20, preferably from C15 to C20. In this case, the alkenyl succinic anhydride will typically comprise at least 80 wt.-% of the mixture, based on the total weight of the mixture, preferably at least 85 wt.-%, more preferably at least 90 wt.-% and most preferably at least 93 wt.-%.

Calcium carbonate-containing filler materials surface-treated with mono-substituted succinic acids and methods for the production thereof are described in WO 2014/060286 A1, WO 2014/128087 A1, and WO 2016/087286 A1.

Accordingly, it is preferred that the surface-treated calcium carbonate-containing filler material comprises a calcium carbonate-comprising filler material having a weight median particle size ($d_{50}$) value from 0.25 μm to 5 μm, preferably from 0.5 to 4 μm, more preferably from 1.0 μm to 3.5 μm, a top cut ($d_{98}$) of ≤10 μm, more preferably of ≤7.5 μm, and a BET specific surface area of from 0.5 to 50 $m^2/g$, preferably of from 0.5 to 35 $m^2/g$ and most preferably of from 0.5 to 15 $m^2/g$, measured using nitrogen and the BET method according to ISO 9277:2010, and a surface-treatment layer on at least a part of the surface of said calcium carbonate-containing filler material, wherein the surface-treatment layer is formed by contacting the calcium carbonate-containing filler material with a surface treatment agent in an amount from 0.1 to 3 wt.-%, based on the total dry weight of the calcium carbonate-containing filler material, and wherein the surface treatment agent comprises a mono-substituted succinic acid anhydride.

For example, the surface-treated calcium carbonate-containing material may have a weight median particle size ($d_{50}$) value in the range from 0.1 μm to 7 μm, a top cut ($d_{98}$) value of 15 μm or less, and a surface-treatment layer formed by contacting the calcium carbonate-containing filler material with a mixture of alkenyl succinic anhydrides and/or alkenyl succinic acids, wherein the alkenyl succinic anhydrides and/or alkenyl succinic acids are mono-substituted with a group selected from any linear or branched mono-alkenyl group having a total amount of carbon atoms from C12 to C20, preferably from C15 to C20. In this case, the alkenyl succinic anhydride will typically comprise at least 80 wt.-% of the mixture, based on the total weight of the mixture, preferably at least 85 wt.-%, more preferably at least 90 wt.-% and most preferably at least 93 wt.-%.

Accordingly, it is preferred that the surface-treated calcium carbonate-containing filler material comprises a calcium carbonate-comprising filler material having a weight median particle size ($d_{50}$) value from 0.25 μm to 5 μm, preferably from 0.5 to 4 μm, more preferably from 1.0 μm to 3.5 μm, a top cut ($d_{98}$) of ≤10 μm, more preferably of ≤7.5 μm, and a BET specific surface area of from 0.5 to 50 $m^2/g$, preferably of from 0.5 to 35 $m^2/g$ and most preferably of from 0.5 to 15 $m^2/g$, measured using nitrogen and the BET method according to ISO 9277:2010, and a surface-treatment layer on at least a part of the surface of said calcium carbonate-containing filler material, wherein the surface-treatment layer is formed by contacting the calcium carbonate-containing filler material with a surface treatment agent in an amount from 0.1 to 3 wt.-%, based on the total dry weight of the calcium carbonate-containing filler material, and wherein the surface treatment agent comprises at least one mono-substituted succinic anhydride, preferably a mixture of alkenyl succinic anhydrides and/or alkenyl succinic acids, wherein the alkenyl succinic anhydrides and/or alkenyl succinic acids are mono-substituted with a group selected from any linear or branched mono-alkenyl group having a total amount of carbon atoms from C12 to C20, preferably from C15 to C20. In this case, the alkenyl succinic anhydride will typically comprise at least 80 wt.-% of the mixture, based on the total weight of the mixture, preferably at least 85 wt.-%, more preferably at least 90 wt.-% and most preferably at least 93 wt.-%.

The Surface-Treatment Layer

It is to be understood that the surface-treatment layer of the surface-treated calcium carbonate-containing filler material is formed by contacting the calcium carbonate-containing filler material with a surface treatment agent. That is, a chemical reaction may take place between the calcium carbonate-containing filler material and the surface treatment agent. In other words, the surface-treatment layer may comprise the surface treatment agent and/or salty reaction products thereof.

For example, if the surface-treatment layer is formed by contacting the calcium carbonate-containing filler material with at least one mono-substituted succinic anhydride and/or mono-substituted succinic acid and/or a salt thereof, the surface-treatment layer may further comprise a salt formed from the reaction of the at least one mono-substituted succinic anhydride and/or mono-substituted succinic acid and/or a salt thereof with the calcium carbonate-containing filler material. Likewise, if the surface-treatment layer is formed by contacting the calcium carbonate-containing filler material with, e.g., octadecanyl succinic anhydride, the surface-treatment layer may further comprise a salt formed from the reaction of octadecanyl succinic anhydride with the calcium carbonate-containing filler material. Analogous reactions may take place when using alternative surface treatment agents according to the present invention.

According to one embodiment the salty reaction product(s) of the mono-substituted succinic acid and/or the at least one mono-substituted succinic anhydride are one or more calcium and/or magnesium salts thereof.

According to one embodiment the salty reaction product(s) of the mono-substituted succinic acid and/or the at least one mono-substituted succinic anhydride formed on at least a part of the surface of the calcium carbonate-comprising filler material are one or more calcium salts and/or one or more magnesium salts thereof.

According to one embodiment the molar ratio of the at least one mono-substituted succinic anhydride and the optional at least one mono-substituted succinic acid to the salty reaction product(s) thereof is from 99.9:0.1 to 0.1:99.9, preferably from 70:30 to 90:10.

According to one embodiment of the present invention, the surface-treated calcium carbonate-containing filler material comprises, and preferably consists of, calcium carbonate-comprising filler material and a treatment layer comprising at least one mono-substituted succinic anhydride and/or at least one mono-substituted succinic acid and/or salty reaction product(s) thereof. The treatment layer is formed on at least a part of the surface, preferably on the whole surface, of said calcium carbonate-comprising filler material.

In case the treatment layer on the surface of the calcium carbonate-comprising filler material comprises at least one mono-substituted succinic acid, it is preferred that the at least one mono-substituted succinic acid is formed from the applied at least one mono-substituted succinic anhydride. That is to say, the substituent of the at least one mono-substituted succinic acid and the substituent of the at least one mono-substituted succinic anhydride are the same.

In one embodiment of the present invention, the treatment layer formed on the surface of the calcium carbonate-comprising filler material comprises the at least one mono-substituted succinic anhydride and at least one mono-substituted succinic acid or salty reaction product(s) thereof obtained from contacting the calcium carbonate-comprising filler material with the at least one mono-substituted succinic anhydride and the optional at least one mono-substituted succinic acid. Alternatively, the treatment layer formed on the surface of the calcium carbonate-comprising filler material comprises the at least one mono-substituted succinic anhydride and at least one mono-substituted succinic acid and salty reaction product(s) thereof obtained from contacting the calcium carbonate-comprising filler material with the at least one mono-substituted succinic anhydride and the optional at least one mono-substituted succinic acid.

The First Polylactic Acid Polymer

The inventive process, the inventive product, the inventive use, and the inventive article make use of a first polylactic acid polymer. In the process of the present invention, the first polylactic acid polymer is compounded with the surface-treated calcium carbonate-containing filler material provided in step a) to form a masterbatch, as will be described in detail below.

Lactic acid having the chemical formula $CH_3CH(OH)CO_2H$ is an organic compound which is a white, water-soluble solid or clear liquid that is produced both naturally and synthetically. Lactic acid is chiral and, therefore, refers to two optical isomers. One is known as L-(+)-lactic acid or (S)-lactic acid and the other, its mirror image, is D-(−)-lactic acid or (R)-lactic acid. A mixture of the two in equal amounts is called DL-lactic acid, or racemic lactic acid. Lactic acid is hygroscopic. DL-lactic acid is miscible with water and with ethanol above its melting point which is around 17 to 18° C. D-lactic acid and L-lactic acid have a higher melting point of 53° C. Lactic acid is known to the skilled person and commercially available, for example, from Sigma Aldrich and Caesar & Loretz GmbH.

There are several industrial routes to produce polylactic acid (PLA) polymers, which are known to the skilled person. Methods and processes for producing polylactic acid are, for example, disclosed in U.S. Pat. No. 7,507,561, in EP 2 607 399 or in WO 2004/057008.

Due to the chirality of lactic acid different types of polylactic acid polymers are known, for example, PLLA (Poly-L-lactic Acid), PDLA (Poly-D-lactic Acid), and PDLLA (Poly-DL-lactic Acid). According to one embodiment of the present invention the first polylactic acid polymer is PLLA. According to another embodiment of the present invention the first polylactic acid polymer is PDLA. According to another embodiment of the present invention the first polylactic acid polymer is PDLLA. According to one embodiment, the first polylactic acid polymer may consist of only one specific type of PLA polymers or a mixture of two or more types of PLA polymers. For example, the first polylactic acid polymer may consist of a mixture of PLLA and PDLLA. According to a preferred embodiment the first polylactic acid polymer consist of only one specific type of PLA polymer. The first polylactic acid polymer may be, for example, PDLLA. Polylactic acid is commercially available, for example from NatureWorks under the trade names Ingeo™ Biopolymer 6100D and Ingeo™ Biopolymer 6202D, and from Total Corbion under the trade name Luminy® L130.

According to one embodiment of the present invention the first polylactic acid polymer is a copolymer of polylactic acid and at least one sort of further monomers. For example, the first polylactic acid polymer is a copolymer of polylactic acid and polyethylene glycol.

According to a preferred embodiment the first polylactic acid polymer is a homopolymer, i.e., poly(2-hydroxypropionic acid).

Depending on its processing and thermal history, PLA may exist both as an amorphous and as a semi-crystalline polymer, i.e. as a polymer comprising crystalline and amorphous fractions. The semi-crystalline material can appear transparent or opaque and white depending on its crystal structure and particle size.

According to one embodiment, the first polylactic acid polymer is amorphous. According to another embodiment, the first polylactic acid polymer is semi-crystalline, preferably the first polylactic acid polymer has a degree of crystallinity of at least 20%, more preferably of at least 40%, and most preferably of at least 50%. According to still another embodiment, the first polylactic acid polymer has a degree of crystallinity from 10 to 80%, more preferably from 20 to 70%, and most preferably from 30 to 60%. The degree of crystallinity may be measured with differential scanning calorimetry (DSC).

According to another embodiment of the present invention, the first polylactic acid polymer has a glass transition temperature, $T_g$, from 35 to 90° C., preferably from 40 to 70° C., and more preferably from 45 to 65° C., measured according to ASTM D3418-15.

According to one embodiment of the present invention, the first polylactic acid polymer has a number average molecular weight from 5000 to 200000 g/mol, preferably from 10000 to 100000 g/mol, and more preferably from 15000 to 80000 g/mol.

According to one embodiment of the present invention, the first polylactic acid polymer has a specific gravity, from 0.5 to 5, preferably from 0.7 to 4, and more preferably from 1 to 3. The term "specific gravity" according to the present invention is the ratio of the density of the PLA to the density of a reference substance; equivalently, it is the ratio of the mass of PLA to the mass of a reference substance for the same given volume. The reference substance is water. The specific gravity is measured according to ASTM D792-13.

According to a preferred embodiment of the present invention the first polylactic acid polymer is PDLLA comprising between 4 to 6 wt.-% of D isomers, based on the total weight of the first polylactic acid polymer. Furthermore, the PDLLA has a specific gravity from 1 to 3 and a glass transition temperature from 45 to 65° C.

In a particularly preferred embodiment, the first polylactic acid polymer has a melt flow rate in the range of from 10 to 40 g/10 min, measured according to EN ISO 1133:2011 under a load of 2.16 kg. Preferably, the melt flow rate ranges from 15 to 30 g/10 min, more preferably from 20 to 30 g/10 min, measured according to EN ISO 1133:2011 under a load of 2.16 kg.

The inventors surprisingly found that the choice of a "fiber-grade" polylactic acid polymer, preferably having a melt flow rate (MFR) as claimed, allows for the efficient dispersion of the surface-treated calcium carbonate containing filler material in the polymer matrix during compounding step d) of the present invention, as will be outlined below. Furthermore, the first polylactic acid polymer is selected for its good processability in fiber formation step f).

In a preferred embodiment, the first polylactic acid polymer further comprises a plasticizer. Plasticizers may improve several properties of polylactic acid polymers, such as its processability, softness, flexibility, pliability and toughness. Without wishing to be bound by any particular theory, it is believed that the plasticizer molecules are embedded between the polymer chains, thereby disrupting polymer-polymer interactions (i.e., "lubricating" the polymer chains) and increasing the polymer free volume. Thus, the glass transition temperature $T_G$ and the elastic modulus of the polylactic acid polymer is reduced. The plasticizer is preferably selected from the group consisting of phthalate esters, such as dimethyl phthalate, diethyl phthalate, dipropyl phthalate, dibutyl phthalate, dihexyl phthalate, diheptyl phthalate, dioctyl phthalate, di(ethylhexyl) phthalate, dinonyl phthalate, di-isononyl phthalate and 2-methoxyethyl phthalate; dialkyl succinates, such as dimethyl succinate, diethyl succinate and dibutyl succinate; glycerol esters, such as glycerol monoacetate, glycerol diacetate, glycerol triacetate (triacetin), glycerol monopropionate, glycerol dipropionate, glycerol tripropionate, glycerol monobutanoate, glycerol dibutanoate, glycerol tributanoate (tributyrin), glycerol monostearate, glycerol distearate and glycerol tristearate; citrate esters, such as triethyl citrate, tri-n-butyl citrate, acetyl tri-n-butyl citrate, acetyl tri-3-methylbutyl citrate, acetyl tri-2-ethylhexyl citrate, acetyl tri-2-octyl citrate, acetyl tri-3-methylbutyl:butyl (1:2) citrate, acetyl tri-2-ethylhexyl:butyl (1:2) citrate and acetyl tri-2-octyl:butyl (1:2) citrate; adipate esters, such as dioctyl adipate, butyl diglycol adipate, methyl diglycol adipate and methyl diglycol benzoate adipate; fatty acid esters, such as oleic acid esters, ricinoleic acid esters, methyl ricinoleate, and erucic acid esters; alkylene glycols, such as ethylene glycol, diethylene glycol, triethylene glycol, tetraethylene glycol, poly(propylene glycol), poly(1,3-propanediol), poly(butylene glycol); alkane diols, such as 1,3-propanediol, 2,2-dimethyl-1,3-propanediol, 1,3-butanediol, 1,4-butanediol, 1,5-pentanediol, 1,6-hexanediol, 2,2,4-trimethyl-1,6-hexanediol, 1,3-cyclohexanedimethanol, 1,4-cyclohexanedimethanol, 2,2,4,4-tetramethyl-1,3-cyclobutanediol; epoxidized vegetable oils, such as epoxidized soybean oil, epoxidized linseed oil and epoxidized castor oil; benzoate esters, such as glycerol benzoate, trimethylol propane tribenzoate and isononylbenzoate; lactide; lactic acid; lactic acid oligomers; glucose monoesters; polymers, such as thermoplastic starch, poly(ethylene oxide), poly(ethylene glycol), poly(ε-caprolactone), poly(vinyl acetate), poly(hydroxybutyrate), cellulose acetate, polybutylene succinate, poly(isobutyl vinyl ether), poly(ethyl vinyl ether)-based polyurethanes, polyalkylene dicarboxylates, and poly(hexamethylene succinate); ionic liquids, such as 1-methyl-3-pentylimidazolium hexafluorophosphate and 1-methyl-3-pentylimidazolium bis (triflimide); and mixtures thereof. Preferably, the plasticizer is a bio-based and/or biodegradable plasticizer. In view thereof, the plasticizer is preferably selected from citrate esters, such as triethyl citrate, tri-n-butyl citrate, acetyl tri-n-butyl citrate, acetyl tri-2-ethylhexyl citrate and acetyl tri-2-octyl citrate; polybutylene succinate; and mixtures thereof.

According to one embodiment of the present invention, the plasticizer may also be covalently attached to and/or copolymerized with the polylactic acid polymer. In this embodiment, the first polylactic acid polymer is a copolymer of polylactic acid and at least one sort of further monomers, wherein the further monomers are preferably selected from the group comprising poly(ε-caprolactone), poly(oxyethylene) and poly(ethylene glycol).

It is appreciated that the first polylactic acid polymer is suitable for compounding with the surface-treated calcium carbonate-comprising filler material as specified above to form a masterbatch, wherein the masterbatch comprises the surface-treated calcium carbonate-containing filler material in an amount of 20 wt.-% to 80 wt.-%, preferably 40 wt.-% to 60 wt.-%, more preferably 45 wt.-% to 55 wt.-%, based on the total weight of the masterbatch.

Preferably, the first polylactic acid polymer has a residual total moisture content of below 400 ppm (weight), more preferably below 200 ppm, still more preferably below 100 ppm and most preferably below 50 ppm. Drying may take place by heating the first polylactic acid polymer to a temperature in the range of from 70 to 100° C., e.g., 80° C., for a duration of 4 to 10 hours, preferably 6 to 8 hours, e.g., in an oven.

The Second Polylactic Acid Polymer

The inventive process, the inventive product, the inventive use, and the inventive article make use of a second polylactic acid polymer. In the process of the present invention, the second polylactic acid polymer is mixed in step e) with a masterbatch comprising the surface-treated calcium carbonate-containing filler material and the first polylactic acid polymer, as will be described in detail below.

It is appreciated that the embodiments described within context of the first polylactic acid polymer above are also applicable to the second polylactic acid polymer. In an exemplary embodiment, the second polylactic acid polymer has a melt flow rate in the range of from 10 to 40 g/10 min, measured according to EN ISO 1133:2011 under a load of 2.16 kg. Preferably, the melt flow rate ranges from 15 to 30 g/10 min, more preferably from 20 to 30 g/10 min, measured according to EN ISO 1133:2011 under a load of 2.16 kg. Likewise, according to a preferred embodiment the second polylactic acid polymer is a homopolymer, i.e., poly(2-hydroxypropionic acid).

The inventors surprisingly found that the choice of a second "fiber-grade" polylactic acid polymer, preferably having a melt flow rate (MFR) as claimed, allows for the efficient dispersion of the surface-treated calcium carbonate containing filler material in the polymer matrix during mixing step e) of the present invention, as will be outlined below. Furthermore, the second polylactic acid polymer is selected for its good processability in fiber formation step f).

Suitable polylactic acid polymers for use as the second polylactic polymer of the present invention are known to the skilled person and, e.g., from the embodiments described for the first polylactic acid polymer above. According to one embodiment of the present invention, the first polylactic acid polymer and the second polylactic acid polymer may be the same polymer. However, the first polylactic acid polymer and the second polylactic acid polymer may also be different polymers.

In a preferred embodiment, the second polylactic acid polymer comprises a plasticizer as described within context of the first polylactic acid polymer above.

Preferably, the second polylactic polymer has a residual total moisture content of below 400 ppm (weight), more preferably below 200 ppm, still more preferably below 100 ppm and most preferably below 50 ppm. Drying may take place by heating the second polylactic acid polymer to a temperature in the range of from 70 to 100° C., e.g., 80° C., for a duration of 4 to 10 hours, preferably 6 to 8 hours, e.g., in an oven.

Process for Producing a Nonwoven Fabric

According to the first aspect of the present invention, a process for producing a nonwoven fabric is provided. The inventive process makes use of the surface-treated calcium carbonate-containing filler material, the first polylactic acid polymer and the second polylactic acid polymer as described hereinabove.

a) The Surface-Treated Calcium Carbonate-Containing Filler Material

According to step a) of the process of the present invention, a surface-treated calcium carbonate-containing filler material as described above is provided.

b) The First Polylactic Acid Polymer

According to step b) of the process of the present invention, a first polylactic acid polymer as described above is provided.

Preferably, the first polylactic acid polymer is provided in a pre-dried form, i.e., the first polylactic acid polymer has a residual total moisture content of below 400 ppm (weight), more preferably below 200 ppm, still more preferably below 100 ppm and most preferably below 50 ppm. Drying may take place by heating the first polylactic acid polymer to a temperature in the range of from 70 to 100° C., e.g., 80° C., fora duration of 4 to 10 hours, preferably 6 to 8 hours, e.g., in an oven.

c) The Second Polylactic Acid Polymer

According to step c) of the process of the present invention, a second polylactic polymer as described above is provided.

Preferably, the second polylactic acid polymer is provided in a pre-dried form, i.e., the second polylactic acid polymer has a residual total moisture content of below 400 ppm (weight), more preferably below 200 ppm, still more preferably below 100 ppm and most preferably below 50 ppm. Drying may take place by heating the second polylactic acid polymer to a temperature in the range of from 70 to 100° C., e.g., 80° C., for a duration of 4 to 10 hours, preferably 6 to 8 hours, e.g., in an oven.

d) Masterbatch Compounding

According to step d) of the process of the present invention, a masterbatch is formed by compounding the surface-treated calcium carbonate-containing filler material of step a) in an amount of 20 wt.-% to 80 wt.-%, based on the total weight of the masterbatch, with the first polylactic acid polymer of step b).

The compounding step d) may be performed by any compounding method known to the skilled person, e.g., by a mixing, kneading or extrusion step.

Preferably, compounding is performed by an extrusion process, wherein a premix of the surface-treated calcium carbonate-containing filler material of step a) and the first polylactic acid polymer of step b) is continuously fed to an extruder, such as a single screw or twin screw extruder. The extruder is heated to a temperature sufficiently high to allow for efficient mixing of the surface-treated calcium carbonate-containing filler material and the first polylactic acid polymer. A suitable temperature range is 170 to 250° C.

Alternatively, the surface-treated calcium carbonate-containing filler material may be added during compounding to the at least partially molten first polylactic acid polymer, e.g., at any split-feed inlet port along the kneading screw of the extruder.

During masterbatch compounding step d), optionally one or more additives, which are well known to the skilled person, may be added to the mixture in an amount of up to 5 wt.-% each, preferably up to 2 wt.-% each, based on the total weight of the masterbatch. Such additives comprise, without being limited to, UV-absorbers, light stabilizers, processing stabilizers, antioxidants, heat stabilizers, nucleating agents, metal deactivators, impact modifiers, plasticizers, lubricants, rheology modifiers, processing aids, pigments, dyes, optical brighteners, antimicrobials, antistatic agents, slip agents, anti-block agents, coupling agents, dispersants, compatibilizers, oxygen scavengers, acid scavengers, markers, antifogging agents, surface modifiers, flame retardants, blowing agents, smoke suppressors, or mixtures of the foregoing additives. Preferred additives are plasticizers, such as those described hereinabove. Preferred pigments are titanium dioxide as white pigment and color pigments, such as blue, green and red pigments. The additives may be provided in pure form, in dissolved form or in form of a masterbatch. However, it should be understood that preferably no further or other filler materials are added during masterbatch compounding step d).

According to another embodiment of the present invention the masterbatch comprises further polymer components. For example, the polymer composition may comprise further polyesters, starch or starch derivatives, polycaprolactone (PCL), cellulose based polymers like cellulose acetate, polyglycols, polyvinyl acetate, polyolefins (with compatibilizer), polyacetals, poly(meth)acrylates, polycarbonate, high rubber content ABS (50-85% rubber), polybutylene succinate or mixtures thereof.

Polyesters are a class of polymers which contain the ester functional group in their main chain and are generally obtained by a polycondensation reaction. Polyesters may include naturally occurring polymers such as cutin as well as synthetic polymers such as polycarbonate or poly butyrate. Depending on their structure polyesters may be bio-degradable.

According to one embodiment, the further polymer component is a polyester selected form the group consisting of a polyglycolic acid, a polycaprolactone, a polyethylene adipate, a polybutylene adipate, a polyhydroxyalkanoate (PHA), a polyhydroxybutyrate, a polyalkylene terephthalate, a polyethylene terephthalate, a polytrimethylene terephthalate, a polybutylene terephthalate, a polyethylene naphthalate, a polybutylene succinate or a mixture thereof, or copolymers thereof. Copolymers thereof may be, for example, poly(butylene adipate-co-terephthalate) (PBAT). Any of these polymers may be in pure form, i.e. in form of a homopolymer, or may be modified by copolymerization and/or by adding one or more substituents to the main chain or side chains of the main chain.

According to another embodiment, the further polymer component is a polyolefin, preferably a polypropylene or a polypropylene-polyethylene copolymer, more preferably an isotactic polypropylene homopolymer having a melt flow rate MFR of 15 to 40 g/10 min, as measured according to IS01133:2011 at 230° C. under a load of 2.16 kg. Polypropylene homopolymers having the desired tacticity may be synthesized, e.g., by suitable Ziegler-Natta polymerization catalysts or metallocene polymerization catalysts known to the person skilled in the art. The isotactic polypropylene homopolymer preferably has a polydispersity index ($M_w/M_n$) of less than 7, preferably less than 4.

Preferably, the further polymer component has a moisture content of less than 700 ppm, more preferably less than 400 ppm, and most preferably less than 200 ppm.

According to one embodiment of the present invention, the masterbatch comprises polylactic acid as polymer component and at least one further polymer component, for example, one or two or three further polymer components. If the polymer composition comprises further polymer components apart from polylactic acid it is preferred that these polymers are bio-degradable. In view thereof, particularly preferred further polymers components are polyglycolic acid and polybutylene succinate, for example, bio-based polybutylene succinate.

According to one embodiment of the present invention the ratio of the polylactic acid to the further polymer components present in the polymer composition is from 99:1 to 20:80, preferably from 95:5 to 50:50 and most preferably from 90:10 to 60:40, based on the weight of the polymer components.

According to a preferred embodiment, no further polymer components are present in the masterbatch and, therefore, the masterbatch comprises the first polylactic acid polymer as the only polymer component.

The masterbatch may be obtained as a material having a defined shape, such as pellets, spheres, pearls, beads, prills, flakes, chips or slugs, or a non-defined shape, such as, for example, crumbles. Alternatively, the masterbatch may be a mixture of both defined and non-defined shape materials.

Preferably, a pelletizing step is performed after the mixing, kneading or extrusion step to provide the masterbatch in the form of pellets.

In a preferred embodiment of the present invention, the masterbatch is formed in step d) by compounding the surface-treated calcium carbonate-containing filler material of step a) in an amount of 40 wt.-% to 60 wt.-%, preferably 45 wt.-% to 55 wt.-%, based on the total weight of the masterbatch, with the first polylactic acid polymer of step b).

The masterbatch comprises the surface-treated calcium carbonate-containing filler material in an amount of from 20 wt.-% to 80 wt.-%, preferably from 40 wt.-% to 60 wt.-% and more preferably from 45 wt.-% to 55 wt.-%, based on the total weight of the masterbatch. It has been found that in the masterbatch, the surface-treated calcium carbonate-containing filler material is uniformly dispersed in the first polylactic acid polymer. Higher concentrations of the surface-treated calcium carbonate-containing filler material in the masterbatch may lead to poor dispersion of the filler material, which may lead to processing problems during fiber spinning, such as filament ruptures and die build-up, and/or may result in a final nonwoven fabric lacking the required mechanical strength characteristics. On the other hand, if a masterbatch of lower concentration is provided, the masterbatch has to be admixed to the second polylactic acid polymer in substantially higher amounts, leading to decreased flexibility in tailoring the properties of the nonwoven fabric by adjusting its composition.

In a preferred embodiment of the present invention, the masterbatch obtained in compounding step d) consists of the surface-treated calcium carbonate-containing filler material of step a) and the first polylactic acid polymer of step b).

In an exemplary embodiment of the present invention, the masterbatch is formed in step d) by compounding the surface-treated calcium carbonate-containing filler material of step a) in an amount of 40 wt.-% to 60 wt.-%, preferably 45 wt.-% to 55 wt.-%, based on the total weight of the masterbatch, with the first polylactic acid polymer of step b), wherein the surface-treated calcium carbonate-containing filler material comprises a surface-treatment layer, wherein the surface-treatment layer is formed by contacting a calcium carbonate-containing filler material with a surface treatment agent in an amount from 0.1 to 3 wt.-%, based on the total dry weight of the calcium carbonate-containing filler material, and wherein the surface treatment agent comprises at least one mono-substituted succinic anhydride. In this embodiment, the first polylactic acid polymer may have a MFR of 10 to 40 g/10 min, preferably 15 to 30 g/10 min, as measured according to IS01133:2011 at 210° C. under a load of 2.16 kg.

e) Mixing of Masterbatch and Second Polylactic Acid Polymer

According to step e) of the process of the present invention, the masterbatch of step d) is mixed with the second polylactic acid polymer of step c) to obtain a mixture.

Mixing step e) may be performed by any means known to the skilled person, including, but not limited to, blending, extruding, kneading, and high-speed mixing. Preferably, mixing step e) is performed by extruding the masterbatch of step d) and the second polylactic acid polymer of step c).

Preferably, the mixture obtained in step e) of the present invention comprises the surface-treated calcium carbonate-containing filler material in a range of 5 wt.-% to 25 wt.-%, preferably 5 to 15 wt.-%, based on the total weight of the mixture. The inventors found that, if the nonwoven fabric is formed from a mixture containing the surface-treated calcium carbonate-containing filler material in the indicated range, the fiber breakage or spinneret clogging during fiber spinning can be reduced, and the process allows for producing the nonwoven fabric with the desired tactile, haptic and mechanical properties at acceptable costs under the specified fiber formation, web laying and web bonding conditions.

In a preferred embodiment of the present invention, the mixture obtained in step e) of the present invention comprises the surface-treated calcium carbonate-containing filler material content in a range of 7 wt.-% to 12 wt.-%, preferably 8 to 11.5 wt.-%, based on the total weight of the mixture.

During mixing step e), optionally one or more additives, which are well known to the skilled person, may be added to the mixture in an amount of up to 5 wt.-% each, preferably up to 2 wt.-% each, based on the total weight of the mixture. Such additives comprise, without being limited to, UV-absorbers, light stabilizers, processing stabilizers, antioxidants, heat stabilizers, nucleating agents, metal deactivators, impact modifiers, plasticizers, lubricants, rheology modifiers, processing aids, pigments, dyes, optical brighteners, antimicrobials, antistatic agents, slip agents, anti-block agents, coupling agents, dispersants, compatibilizers, oxygen scavengers, acid scavengers, markers, antifogging agents, surface modifiers, flame retardants, blowing agents, smoke suppressors, or mixtures of the foregoing additives. Preferred additives are plasticizers, such as those described hereinabove. Preferred pigments are titanium dioxide as white pigment and color pigments, such as blue, green and red pigments. The additives may be provided in pure form, in dissolved form or in form of a masterbatch. For example, the additives may be incorporated in and provided with the masterbatch of step d) or may be provided with a separate masterbatch, which may comprise one or more polymers other than polylactic acid. Suitable polymers are those described for process step d) hereinabove. However, it should be understood that preferably no further or other filler materials are added during mixing step e).

Furthermore, suitable further polymer compounds, such as those described in process step d) hereinabove, may be added in mixing step e). However, it is preferred that the further polymers are biodegradable. Preferred examples of suitable further polymer compounds include polyglycolic acid and polybutylene succinate (PBS). In a preferred embodiment, the mixture obtained in step e) does not contain further polymer compounds (other than the first and second polylactic acid polymers).

In an exemplary embodiment, the mixture of step e) consists essentially of the surface-treated calcium carbonate-containing filler material of step a) in an amount of 5 wt.-% to 25 wt.-%, preferably 5 wt.-% to 15 wt.-%, more preferably 8 to 11.5 wt.-%, based on the total weight of the mixture, the first polylactic acid polymer of step b) and the second polylactic acid polymer of step c), and optionally one or more additives in an amount of up to 5 wt.-% each, preferably up to 2 wt.-% each, based on the total weight of the mixture.

In another exemplary embodiment, the mixture of step e) consists essentially of the surface-treated calcium carbonate-containing filler material of step a) in an amount of 5 wt.-% to 25 wt.-%, preferably 5 wt.-% to 15 wt.-%, more preferably 8 to 11.5 wt.-%, based on the total weight of the mixture, the first polylactic acid polymer of step b) and the second polylactic acid polymer of step c), and optionally one or more additives selected from the group consisting of UV-absorbers, processing aids, pigments, such as titanium dioxide as white pigment and color pigments, such as blue, green and red pigments, dyes, optical brighteners, antimicrobials, antistatic agents, and flame retardants in a total amount of up to 5 wt.-%, and an individual amount of up to 2 wt.-% each, based on the total weight of the mixture.

f) Fiber Formation

According to step f) of the process of the present invention, the mixture of step e) is formed into fibers.

Appropriate method conditions for preparing staple fibers and/or filaments are commonly known to the skilled person and/or can be established by routine modifications based on common general knowledge.

The cross-section of the filaments and/or staple fibers may have a great variety of shapes. It is preferred that the cross-sectional shape of the filaments and/or staple fibers may be round, oval or n-gonal, wherein n is ≥3, e.g. n is 3. For example, the cross-sectional shape of the filaments and/or staple fibers is round or trilobal, like round. Additionally or alternatively, the cross-sectional shape of the filaments and/or staple fibers is hollow.

It is appreciated that the filaments and/or staple fibers may be prepared by all techniques known in the art used for preparing such filaments and/or staple fibers. For example, the filaments and/or staple fibers of the present invention can be prepared by the well-known melt-blown process, spunbonded process or by staple fiber production.

In accordance with known technology such as the continuous filament spinning for filaments or staple fibers, and nonwoven processes such as spunbond production and melt-blown production, the fibers and filaments can be formed by extrusion of the molten polymer through small orifices of a spinneret. In general, the fibers or filaments thus formed are then drawn or elongated to induce molecular orientation and affect crystallinity, resulting in a reduction in diameter and an improvement in physical properties.

Spunmelt is a generic term describing the manufacturing of nonwoven materials directly from thermoplastic polymer compositions. It encompasses 2 processes (spunlaid and meltblown) and the combination of both. In this process polymer granules are melted and molten polymer is extruded through a spinneret assembly which creates a plurality of continuous polymeric filaments. The filaments are then quenched and drawn by an air flow, and collected to form a nonwoven fabric.

The spunlaid process (also known as spunbonded) has the advantage of giving nonwovens greater strength. Co-extrusion of second components is used in several spunlaid processes, usually to provide extra properties or bonding capabilities. In meltblown web formation, low viscosity polymers are extruded into a high velocity airstream on leaving the spinneret. This scatters the melt, solidifies it and breaks it up into a fibrous web.

Processes are well known in the art, and are commercially available, for producing spunlaid fabrics. Typical processes are known, such as the LUTRAVIL, DOCAN, REIFENHÄUSER, or ASON process. The extrusion of molten polymer through spinneret orifices is followed by the newly formed extruded filaments being quenched with air and drawn by suction and being disbursed on a conveyor belt to form a nonwoven fabric.

According to one embodiment of the present invention, the mixture of step e) is formed into fibers by combining a melt blown process and a spunbond process as described above.

It is appreciated that the steps e) and f) of the process of the present invention may be performed at the same time. For example, if mixing step e) is performed by extruding the masterbatch of step d) and the second polylactic polymer of step c), the molten mixture may be directly extruded through small orifices of a spinneret to form the fibers in the spunlaid or meltblown process or a combination of both.

In a preferred embodiment, the mixture of step e) is extruded in step f) to form fibers at a temperature from 210° C. to 250° C., preferably from 215° C. to 235° C., and most preferably from 220° C. to 225° C.

The fibers formed in the process of the present invention may be drawn or elongated to induce molecular orientation and affect crystallinity. This may result in a reduction in diameter and an improvement in physical properties.

According to one embodiment the process further comprises a step of drawing the fibers. The fiber may be drawn or elongated with the help of godet wheels. The length to which the fiber is drawn will depend on the desired properties. For higher tenacity, the fiber may be drawn to a greater extent. According to one embodiment, the fiber is drawn up to two times, three times, four times, five times, or six times its original length.

According to one embodiment, the fiber obtained by the process of the present invention is heat-set, preferably at a temperature from 100° C. to 150° C., preferably from 110° C. to 130° C. Heat-setting may impart dimensional stability to the fiber by bringing the macromolecules closer to their equilibrium state, so that resistance to thermal shrinkage, dimensional changes, curling or snarling of twisted yarns, or creasing of fabrics can be attained.

According to one embodiment, the fiber obtained by the process of the present invention is textured. The texturing is a procedure used to increase the volume and the elasticity of a fiber. When textured, flat filaments can acquire volume and bulk. The texturing step can be carried out separately or, if the drawing step is present, the fiber can be textured during or after the drawing step.

In a preferred embodiment, the filaments and/or staple fibers have an average fiber diameter in the range from 8 to 29 μm, preferably from 9 to 25 μm and more preferably from 12 to 21 μm.

In one embodiment of the present invention, the mixture of step e) is formed into filaments by the spunlaid process, as described above. In this embodiment, filament diameters range from 9 to 25 μm, preferably 12 to 21 μm. The skilled person will appreciate that the filament diameter may be adjusted by choosing a spinneret having an appropriate hole diameter and a suitable drawing ratio. Accordingly, the filaments will show a titer in the range of 1 to 6 dtex, preferably 1.5 to 4 dtex.

In another embodiment of the present invention, the mixture of step e) is formed into staple fibers according to a two-step or a one-step process. The staple fibers may be produced from filaments, obtained as described above, and optionally crimped. The filaments are then cut into staple fibers of a defined length. In this embodiment, filament diameters range from 9 to 25 μm, preferably 12 to 21 μm. The skilled person will appreciate that the staple fiber diameter may be adjusted by choosing a spinneret having an appropriate hole diameter and a suitable drawing ratio for the production of the filaments, which are then formed into staple fibers. Accordingly, the staple fibers will show a titer in the range of 1 to 6 dtex, preferably 1.5 to 4 dtex. Furthermore, the staple fibers have a staple length in the range of 30 to 90 mm, and preferably 40 to 60 mm. The staple length is adjusted by appropriately adjusting the process conditions of the cutting step. Optionally, the staple fibers may be assembled into bales.

g) Fibrous Web Formation

According to step g) of the process of the present invention, the fibers of step f) are formed into a fibrous web.

Appropriate method conditions for preparing fibrous webs are commonly known to the skilled person and/or can be established by routine modifications based on common general knowledge. For example, fibrous webs may be prepared by drylaying techniques, such as carding or airlaying, or by wetlaying of staple fibres, or by spunlaying of the continuous filaments. Although these methods may cause some of the filaments or fibers to adhere to one another, this cannot be regarded as the principal method of bonding.

In another exemplary embodiment of the present invention, staple fibers obtained in step f) are formed into a fibrous web by carding. Carding is a mechanical process, wherein the staple fibers are combed into a web by a carding machine, which may be a rotating drum or series of drums covered in fine wires or teeth. The precise configuration of cards will depend on the desired fabric weight and fiber orientation. The web can be parallel-laid, where most of the fibers are laid in the direction of the web travel, or they can be random-laid. Typical parallel-laid carded webs result in good tensile strength, low elongation and low tear strength in the machine direction and the reverse in the cross direction. Relative speeds and web composition can be varied to produce a wide range of fabrics with different properties.

In this embodiment of the process of the present invention, the fibrous web comprises staple fibers having a filament diameter in the range from 9 to 25 μm, preferably 12 to 21 μm, a titer in the range of 1 to 6 dtex, preferably 1.5 to 4 dtex, and a staple length in the range of 30 to 90 mm, preferably 40 to 60 mm.

In another embodiment of the present invention, the fibrous web comprises filaments having a filament diameter in the range from 9 to 25 μm, preferably 12 to 21 μm and a titer in the range of 1 to 6 dtex, preferably 1.5 to 4 dtex.

It is understood that steps f) and g) of the present invention may be performed in a single operational step or in separate steps. For example, if filaments are formed by the meltblown process, the freshly extruded fibers may be sprayed directly onto and/or deposited onto a suitable surface, such as a chill roll or a conveyor belt, forming the fibrous web precursor.

According to one embodiment, in step g) the nonwoven fabric is formed by collecting the fibers on a surface or carrier. For example, the fibers can be collected on a foraminous or perforated surface such as a moving screen or a forming wire. The fibers may be randomly deposited on the foraminous or perforated surface so as to form a non-woven fabric, which may be held on the surface by a vacuum force.

Alternatively, filaments may be formed separately into a fibrous web by any filament laying step known to the skilled person.

According to one embodiment of the present invention, in steps f) and g) the mixture is formed into fibers by combining one or more of a melt blown process and a spunbond process and/or dry laid- or wet laid- or air laid process as described above in any order.

By combining a meltblown and a spunbond process, a multilayer nonwoven web precursor can be produced, for example, a nonwoven web precursor comprising two outer layers of spunbond fabric and an inner layer of a meltblown web precursor, which is known in the art as spundbonded-meltblown-spunbonded (SMS) web precursor. Additionally either or both of these processes may be combined in any arrangement with a staple fiber carding process.

The nonwoven fabric produced by the inventive process can be a multilayered nonwoven fabric, preferably a spundbonded-meltblown-spunbonded (SMS), a meltblown-spunbonded-meltblown (MSM), a spundbonded-meltblown-spunbonded-meltblown (SMSM), a meltblown-spunbonded-meltblown-spunbonded (MSMS), a spundbonded-meltblown-meltblown-spunbonded (SMMS), or a meltblown-spunbonded-spunbonded-meltblown (MSSM) nonwoven fabric. Said nonwoven fabric may be compressed in order to ensure the cohesion of the layers, for example, by lamination.

According to one embodiment, steps f) and g) of the inventive process are repeated two or more times to produce a multilayer web precursor, preferably a spundbonded-meltblown-spunbonded (SMS), a meltblown-spunbonded-meltblown (MSM), a spundbonded-meltblown-spunbonded-meltblown (SMSM), a meltblown-spunbonded-meltblown-spunbonded (MSMS), a spundbonded-meltblown-meltblown-spunbonded (SMMS), or a meltblown-spunbonded-spunbonded-meltblown (MSSM) web precursor. However, it is appreciated that further multilayer web precursors, such as a spunlaid-airlaid-carded (SAC) web precursor, may be produced.

h) Web Bonding

According to step h) of the process of the present invention, the nonwoven fabric is formed from the fibrous web of step g) by a bonding step, that is, by hydroentanglement or calendering.

According to one embodiment, the nonwoven fabric is formed from the fibrous web of step g) by a hydroentanglement step. FIG. 1 shows the schematic process of one of the one or more bonding steps of the hydroentanglement process. Hydroentanglement, also known as spunlacing, is a process which employs high pressure water jets (23) to entangle fibers in a loose web (10), thereby creating a fabric (11) held together by frictional forces between the said fibers. The loose web (10) is conveyed on a microperforated sleeve (31) located on a perforated support (30) and is held on said support by means of a vacuum (32). Water jets (23) are produced by passing water (21) in a high pressure injector (20) through a strip of holes (22).

The inventors surprisingly found out that the hydroentangling step allows for obtaining a nonwoven fabric having the desired haptic properties, while preferably retaining the mechanical and absorbent properties of the nonwoven fabric at acceptable costs. For example, if the web precursor is fastened by chemical bonding, the surface of the nonwoven fabric would be smoothened, causing the nonwoven fabric to lose its advantageous tactile and haptic properties. Furthermore, the space between the fibers would be congested, leading to a decreased absorption capacity.

In a preferred embodiment, the hydroentanglement is performed as a two-step process comprising a pre-bonding step and one or more bonding steps.

In the pre-bonding step, the web precursor of step g) is wetted to eliminate air pockets and to ensure the fiber cohesion and adhesion between the loose web (10) and the microperforated sleeve (31) during web precursor handling. Furthermore, this step serves as a first compaction step. The pre-bonding step is advantageously performed at water pressures of about 50 bar to 120 bar, preferably 60 bar to 110 bar, more preferably 65 bar to 105 bar. Preferably, the pre-bonding step is performed at a water pressure below the water pressure used in the bonding step. For example, a pre-bonding step may be performed in a cylinder comprising one or more injectors, preferably two injectors. Each injector comprises a strip of holes, which direct the water jet onto the fibrous web. For example, a strip of holes may comprise one or more rows of holes, preferably two rows of holes. The holes may have a diameter in the range of 60 μm to 200 μm, preferably 80 μm to 180 μm, more preferably 80 μm to 160 μm, and most preferably 100 μm to 140 μm. The gap between each hole may be in the range of 0.6 mm to 2 mm, preferably 0.8 mm to 1.8 mm, and more preferably 1 mm to 1.6 mm.

In the following one or more bonding steps, the fibers are entangled, which fastens the nonwoven fabric. For example, a bonding step may be performed in a cylinder comprising one or more injectors (20), preferably two injectors (20). Each injector (20) comprises a strip of holes (22), which direct the water jet (23) onto the fibrous web (10). For example, a strip of holes (22) may comprise one or more rows of holes, preferably two rows of holes. The holes may have a diameter in the range of 60 μm to 200 μm, preferably 80 μm to 180 μm, more preferably 80 μm to 160 μm, and most preferably 100 μm to 140 μm. The gap between each hole may be in the range of 0.6 mm to 2 mm, preferably 0.8 mm to 1.8 mm, and more preferably 1 mm to 1.6 mm.

The one or more bonding steps may be performed at water pressures in the range of 90 bar to 250 bar, preferably from 95 bar to 225 bar, more preferably from 100 bar to 200 bar, and most preferably from 100 bar to 175 bar. However, it is appreciated that the final bonding step is performed at water pressures in the range of 90 bar to 250 bar, preferably from 95 bar to 225 bar, more preferably from 100 bar to 200 bar, and most preferably from 100 bar to 175 bar. Preferably, the one or more bonding steps are performed at water pressures, which are higher than the water pressure of the pre-bonding step. Furthermore, each subsequent bonding step of the one or more bonding step may be performed at a higher, lower, or equal water pressure compared to the preceding bonding step.

It is preferred that the one or more bonding steps are performed at water pressures, which do not exceed 250 bar, preferably 225 bar, and more preferably 200 bar. The inventors found out that higher water pressures may lead to an increased compaction of the material, and may cause the tactile and haptic properties to be less favorable. Furthermore, it is desirable from an ecologic point of view to perform the bonding steps at lower water pressures, as less energy is required to generate the water jets.

In an exemplary embodiment, the web precursor of step f) is hydroentangled in step h) by a process comprising a pre-bonding step, which is performed at a water pressure in the range of from 60 bar to 110 bar, preferably 65 bar to 105 bar, and one or more, preferably two, bonding steps, which are performed at a water pressure in the range of 90 bar to 250 bar, preferably 95 bar to 225 bar, and wherein the water pressure of the final bonding step is in the range of 90 bar to 250 bar, preferably 95 bar to 225 bar. It is appreciated that each of the pre-bonding step and the bonding steps may be performed on the same or different cylinders comprising one or more, preferably two injectors (20) having the same or different configuration, such as a strip of holes (22) comprising one or more rows of holes, preferably two rows of holes, wherein the holes may have a diameter in the range of 80 μm to 180 μm, preferably 80 μm to 160 μm, and more preferably 100 μm to 140 μm, and wherein the gap between each hole may be in the range of 0.8 mm to 1.8 mm, preferably 1 mm to 1.6 mm. However, it is preferred that each of the pre-bonding step and the bonding steps may be performed on different cylinders comprising one or more, preferably two injectors (20) having the same configuration, such as a strip of holes (22) comprising one or more rows of holes, preferably two rows of holes, wherein the holes may have a diameter in the range of 80 μm to 180 μm, preferably 80 μm to 160 μm, and more preferably 100 μm to 140 μm, and wherein the gap between each hole may be in the range of 0.8 mm to 1.8 mm, preferably 1 mm to 1.6 mm.

It is appreciated that in any of the embodiments as described herein, at least 95%, preferably at least 98%, more preferably at least 99% of the process water used during the hydroentanglement step may be recycled.

It is appreciated that a multilayered nonwoven fabric may be obtained by subjecting a multilayered nonwoven web precursor as described in step g) to the hydroentanglement step h).

After the bonding step, the nonwoven fabric is dried by means known to the skilled person. For example, the nonwoven fabric may be dried by air blowing or tumble drying. It is appreciated that the drying step is performed at a temperature well below the glass transition temperature of the polymer compound to avoid sticking of the fibers. Preferably, drying is performed at a temperature below 135°

C., more preferably below 120° C., even more preferably below 100° C., for example at about 90° C.

In an exemplary embodiment, the nonwoven fabric, which is obtained in step h) by a process comprising a pre-bonding step, which is performed at a water pressure in the range of from 60 bar to 110 bar, preferably 65 bar to 105 bar, and one or more, preferably two, bonding steps, which are performed at a water pressure in the range of 90 bar to 250 bar, preferably 95 bar to 225 bar, and wherein the water pressure of the final bonding step is in the range of 90 bar to 250 bar, preferably 95 bar to 225 bar, may be dried at a temperature below 135° C., more preferably below 120° C., even more preferably below 100° C., for example at about 90° C.

It is appreciated that the process as described above enables the skilled person to obtain a nonwoven fabric having the desirable tactile, haptic and mechanical properties as described. Based on the description of the process of the present invention, the skilled person will be enabled to implement further obvious and/or routine modifications to obtain a nonwoven fabric as described herein.

According to another embodiment, the nonwoven fabric is formed from the fibrous web of step g) by a calendering step. Thermal point bonding or calendering is a commonly used method, which uses heat and pressure applied through cylinders (also called rolls or rollers) to bond the fibers of the fibrous web together. The method is illustrated in FIG. 2 and involves passing the fibrous web to be bonded (10) through heated cylinder rolls (41, 42) under pressure to obtain the bonded nonwoven fabric (11). The top cylinder (42), also termed calender roll, may be patterned, as shown in FIG. 2, or may be smooth (not shown). The bottom cylinder (42), also termed anvil roll, is usually smooth. The top cylinder (42) is usually patterned in some way so that the entire fabric (11) is not bonded across its entire surface. Various patterns can be used in the process of the present invention without affecting the mechanical properties of the nonwoven fabric. For instance, the nonwoven fabric can be bonded according to a ribbed knit pattern, a wire weave pattern, a diamond pattern, and the like. The calendered fabric (11) may then be wound up on a wind up roll (50).

In a preferred embodiment, the calendering step is performed at a temperature in the range from 120° C. to 160° C., preferably from 130° C. to 150° C., or from 140° C. to 160° C. Therefore, the top cylinder (42), which may be patterned or smooth, may have a temperature in the range of from 120° C. to 170° C., preferably from 130° C. to 160° C., and more preferably from 135° C. to 150° C. The bottom cylinder (41) may have a temperature in the range of from 115° C. to 170° C., preferably from 125° C. to 160° C. and more preferably from 130° C. to 150° C. It is preferred that the temperature of the bottom cylinder (41) is lower than or equal to the temperature of the top cylinder (42), e.g., by at most 15° C., preferably by at most 10° C. and more preferably by at most 5° C.

The heated cylinder rolls (41, 42) exert a certain pressure on the fibrous web (10) in order to bond the fibers together. Preferably, the pressure is in the range from 10 to 70 N/mm, more preferably from 20 to 60 N/mm, and most preferably from 25 to 55 N/mm, for example about 30 N/mm or about 50 N/mm.

The skilled person will routinely adjust the line speed and/or the contact time of the fibrous web (10) with the heated cylinder rolls (41, 42) and will routinely employ cooling means according to the specific needs. In an exemplary embodiment of the process of present invention, the nonwoven fabric as obtained in the process comprises fibers having an average fiber diameter in the range of 8 to 29 μm, wherein the fibers comprise from 5 wt.-% to 15 wt.-% of a surface-treated calcium carbonate-containing filler material, based on the total weight of the fibers, a first polylactic acid polymer having a melt flow rate MFR of 10 to 40 g/10 min, as measured according to ISO1133:2011 at 210° C. under a load of 2.16 kg, and a second polylactic acid polymer having a melt flow rate MFR of 10 to 40 g/10 min, as measured according to ISO1133:2011 at 210° C. under a load of 2.16 kg. In this exemplary embodiment, the surface-treated calcium carbonate-containing filler material comprises a calcium carbonate-comprising filler material having a weight median particle size ($d_{50}$) value from 0.25 μm to 5 μm, preferably from 0.5 to 4 μm, more preferably from 1.0 μm to 3.5 μm, a top cut ($d_{98}$) of 10 μm, more preferably of 7.5 μm, and a BET specific surface area of from 0.5 to 50 $m^2/g$, preferably of from 0.5 to 35 $m^2/g$ and most preferably of from 0.5 to 15 $m^2/g$, measured using nitrogen and the BET method according to ISO 9277:2010, and a surface-treatment layer on at least a part of the surface of said calcium carbonate-containing filler material, wherein the surface-treatment layer is formed by contacting the calcium carbonate-containing filler material with a surface treatment agent in an amount from 0.1 to 3 wt.-%, based on the total dry weight of the calcium carbonate-containing filler material, and wherein the surface treatment agent comprises at least one mono-substituted succinic anhydride, preferably a mixture of alkenyl succinic anhydrides and/or alkenyl succinic acids, wherein the alkenyl succinic anhydrides and/or alkenyl succinic acids are mono-substituted with a group selected from any linear or branched mono-alkenyl group having a total amount of carbon atoms from C12 to C20, preferably from C15 to C20. In this case, the alkenyl succinic anhydride will typically comprise at least 80 wt.-% of the mixture, based on the total weight of the mixture, preferably at least 85 wt.-%, more preferably at least 90 wt.-% and most preferably at least 93 wt.-%. The nonwoven fabric according to this embodiment is bonded by a hydroentanglement step.

In another exemplary embodiment of the process of present invention, the nonwoven fabric as obtained in the process comprises fibers having an average fiber diameter in the range of 8 to 29 μm, wherein the fibers comprise from 5 wt.-% to 15 wt.-% of a surface-treated calcium carbonate-containing filler material, based on the total weight of the fibers, a first polylactic acid polymer having a melt flow rate MFR of 10 to 40 g/10 min, as measured according to ISO1133:2011 at 210° C. under a load of 2.16 kg, and a second polylactic acid polymer having a melt flow rate MFR of 10 to 40 g/10 min, as measured according to ISO1133:2011 at 210° C. under a load of 2.16 kg. In this exemplary embodiment, the surface-treated calcium carbonate-containing filler material comprises a calcium carbonate-comprising filler material having a weight median particle size ($d_{50}$) value from 0.25 μm to 5 μm, preferably from 0.5 to 4 μm, more preferably from 1.0 μm to 3.5 μm, a top cut ($d_{98}$) of ≤10 μm, more preferably of 7.5 μm, and a BET specific surface area of from 0.5 to 50 $m^2/g$, preferably of from 0.5 to 35 $m^2/g$ and most preferably of from 0.5 to 15 $m^2/g$, measured using nitrogen and the BET method according to ISO 9277:2010, and a surface-treatment layer on at least a part of the surface of said calcium carbonate-containing filler material, wherein the surface-treatment layer is formed by contacting the calcium carbonate-containing filler material with a surface treatment agent in an amount from 0.1 to 3 wt.-%, based on the total dry weight of the calcium carbonate-containing filler material, and wherein the surface treatment agent comprises at least one mono-substituted succinic anhydride, preferably a mixture of alkenyl succinic anhydrides and/or alkenyl succinic acids, wherein the alkenyl succinic anhydrides and/or alkenyl succinic acids are mono-substituted with a group selected from any linear or branched mono-alkenyl group having a total amount of carbon atoms from C12 to C20, preferably from C15 to C20. In this case, the alkenyl succinic anhydride will typically comprise at least 80 wt.-% of the mixture, based on the total weight of the mixture, preferably at least 85 wt.-%, more preferably at least 90 wt.-% and most preferably at least 93 wt.-%. The nonwoven fabric according to this embodiment is bonded by a calendering step.

According to an optional embodiment of the inventive process, the obtained nonwoven fabric is subjected to a post-treatment step. It is appreciated that the post-treatment step is selected from post-treatments, which do not disturb the tactile, haptic and mechanical properties of the nonwoven fabric, such as printing, dyeing, embossing, creping, raising or perforation.

It is to be understood that the embodiments and features of the process of the present invention as described hereinabove also apply to the inventive product, the inventive use and the article comprising the inventive product.

The Nonwoven Fabric

According to a second aspect of the present invention, a nonwoven fabric is provided. It is appreciated that the nonwoven fabric is formed from fibers composed of a mixture comprising a first polylactic acid polymer, a second polylactic acid polymer and a surface-treated calcium carbonate-containing filler material as described hereinabove. Thus, it is appreciated that the nonwoven fabric may be formed from fibers as defined in step f) of the process of the present invention.

In a preferred embodiment, the nonwoven fabric may be formed by a process comprising a calendering or hydroentanglement step. In a particularly preferred embodiment, the nonwoven fabric is formed by a process in accordance with the first aspect of the invention described hereinabove.

The inventive nonwoven fabric has desirable tactile and haptic properties, as well as suitable mechanical properties, as described above. The desirable haptic properties may be inter alia reflected by a suitable air permeability, which is an indication of the "fluffiness" or "downiness" of the obtained nonwoven fabrics. The air permeability of the obtained nonwoven fabric is in the range from 1000 to 10000 L/($m^2$ s). However, it is to be understood that the air permeability will depend on the thickness of the nonwoven fabric and on the fabric weight. Generally, a higher air permeability at comparable fabric weight is an indication to an improved "fluffiness" or "downiness".

Use of the Coated Calcium Carbonate in the Inventive Nonwoven Fabric

According to a third aspect of the present invention, the use of a surface-treated calcium carbonate-containing filler material for the manufacture of a nonwoven fabric comprising a polylactic acid polymer is provided. It is appreciated that the surface-treated calcium carbonate-containing filler material is described hereinabove. Furthermore, the polylactic acid polymer of the present aspect of the invention relates to the first and/or the second polylactic acid polymer as described hereinabove.

The use of the surface-treated calcium carbonate-containing filler material imparts the desired tactile, haptic and mechanical properties to the nonwoven fabric. Furthermore, good mechanical properties and the biodegradability is provided.

Articles Comprising the Nonwoven Fabric

According to the fourth aspect of the present invention, an article comprising the nonwoven fabric as defined above is provided. The article is preferably selected from the group comprising hygiene products, medical and healthcare products, filter products, geotextile products, agriculture and horticulture products, clothing, footwear and baggage products, household and industrial products, packaging products, construction products and the like.

In view of the good tactile and haptic properties of the nonwoven fabrics obtained in the process as described herein, in one preferred embodiment the article comprising the nonwoven fabric is selected from the group consisting of hygiene products, medical and healthcare products.

In view of the good mechanical properties and the biodegradability of the nonwoven fabrics obtained in the process as described herein, in another preferred embodiment the article comprising the nonwoven fabric is selected from the group consisting of geotextile products, agriculture and horticulture products.

Preferably, the hygiene products are selected from the group comprising absorbent hygiene products such as baby diapers or nappies, feminine hygiene, adult incontinence products, depilatory strips, bandages and wound dressings, disposable bath and face towels, disposable slippers and footwear, top sheets or coverstocks, consumer face masks, leg cuffs, acquisition/distribution layers, core wraps, back sheets, stretch ears, landing zones, dusting layers and fastening systems; and wipes.

In a particularly preferred embodiment, the article is selected from wipes, preferably personal care wipes, such as wet wipes, skin care wipes, baby wipes, facial wipes, cleansing wipes, hand and body wipes, moist towelettes, personal hygiene wipes, feminine hygiene wipes, or from wipes such as household care wipes, floor care wipes, cleaning wipes, pet care wipes, antibacterial wipes and medicated wipes.

Preferably, the medical and healthcare products are selected from the group comprising medical products which can be sterilized, medical packaging, caps like surgical disposable caps, protective clothing, surgical gowns, surgical masks and face masks, surgical scrub suits, surgical covers, surgical drapes, wraps, packs, sponges, dressings, wipes, bed linen, contamination control gowns, examination gowns, lab coats, isolation gowns, transdermal drug delivery, shrouds, underpads, procedure packs, heat packs, ostomy bag liners, fixation tapes, incubator mattress, sterilisation wraps (CSR wrap), wound care, cold/heat packs, drug delivery systems like patches.

Preferably, the filter products are selected from the group comprising gasoline filters, oil filters, air filters, water filters, coffee filters, tea bags, pharmaceutical industry filters, mineral processing filters, liquid cartridge and bag filters, vacuum bags, allergen membranes and laminates with nonwoven layers.

Preferably, the geotextile products are selected from the group comprising soil stabilizers and roadway underlayment, foundation stabilizers, erosion control, canals construction, drainage systems, geomembrane protection, frost protection, agriculture mulch, pond and canal water barriers, sand infiltration barrier for drainage tile and landfill liners.

Preferably, the agriculture and horticulture products are selected from the group comprising crop covers, plant protection, seed blankets, weed control fabrics, greenhouse shading, root control bags, biodegradable plant pots, capillary matting, and landscape fabric.

Preferably, the clothing, footwear and baggage products are selected from the group comprising interlinings like fronts of overcoats, collars, facings, waistbands, lapels etc., disposable underwear, shoe components like shoelace eyelet reinforcement, athletic shoe and sandal reinforcement and inner sole lining etc., bag components, bonding agents, composition and (wash) care labels.

Preferably, the packaging products are selected from the group comprising interlinings like desiccant packaging, sorbents packaging, gift boxes, file boxes, nonwoven bags, book covers, mailing envelopes, Express envelopes, courier bags and the like.

Preferably, the household and industrial products are selected from the group comprising abrasives, bed linen like pocket cloth for pocket springs, separation layer, spring cover, top cover, quilt backing, duvet coverings, pillow cases etc., blinds/curtains, carpet/carpet backings like scatter rugs, carpet tiles, bath mats etc., covering and separation material, detergent pouches, fabric softener sheets, flooring, furniture/upholstery like inside lining, reverse fabric for cushions, dust cover, spring covering, pull strips etc., mops, table linen, tea and coffee bags, vacuum cleaning bags, wall-covering, automotive building, cable wrapping, civil engineering, filtration packaging, protective clothing, primary and secondary carpet backing, composites, marine sail laminates, tablecover laminates, chopped strand mats, backing/stabilizer for machine embroidery, packaging where porosity is needed, insulation like fiberglass batting, pillows, cushions, padding like upholstery padding, batting in quilts or comforters, mailing envelopes, tarps, tenting and transportation (lumber, steel) wrapping, disposable clothing like foot coverings and coveralls, and weather resistant house wraps.

Preferably, the construction products are selected from the group comprising house wrap, asphalt overlay, road and railroad beds, golf and tennis courts, wallcovering backings, acoustical wall coverings, roofing materials and tile underlayment, soil stabilizers and roadway underlayment, foundation stabilizers, erosion control, canals construction, drainage systems, geomembrane protection, frost protection, agriculture mulch, pond and canal water barriers, and sand infiltration barriers for drainage tile.

The following examples are meant to additionally illustrate the invention. However, the examples are not meant to restrict the scope of the invention in any way.

EXAMPLES

Measurement Methods

In the following, measurement methods and materials implemented in the examples are described.

Particle Size

The particle distribution of the calcium carbonate filler was measured using a Sedigraph 5120 from the company Micromeritics, USA. The method and the instruments are known to the skilled person and are commonly used to determine grain size of fillers and pigments. The measurement was carried out in an aqueous solution comprising 0.1 wt.-% $Na_4P_2O_7$. The samples were dispersed using a high speed stirrer and supersonics.

Filter Pressure Value (FPV)

The filter pressure test was performed on a commercially available Collin Pressure Filter Test Teach-Line FT-E20T-IS (Colin Lab & Pilot Solutions GmbH, Maitenbeth, Germany). The test method was performed in agreement with European Standard EN 13900-5 with each of the corresponding polymer compositions (16 g effective calcium carbonate per 200 g of final sample, diluent: PLA NatureWorks Ingeo™ Biopolymer 6100D) using a 14 μm type 30 filter (GKD Gebr. Kufferath AG, Düren, Germany), wherein no melt pump was used, the extruder speed was kept at 100 rpm, and wherein the melt temperature was 225 to 230° C. (temperature setting: 190° C./210° C./230° C./230° C./230° C.).

Titer or Linear Density (Continuous Filaments)

The titer or linear density [dtex] was measured according to EN ISO 2062:2009 and corresponds to the weight in grams of 10 000 m fiber. A sample of 25 or 100 metres was wound up on a standard reel under a pretension of 0.5 cN/tex and weighted on analytical scale. The grams per 10 000 m fiber length were then calculated.

Fiber Diameter (Staple Fibers and Spunlaid Fibers)

The fiber diameter [μm] was measured according to EN ISO 137:2015. A nonwoven sample, or fiber sample was placed into a microscope (MESDAN Micro Lab 250E). The analysis consists of the measurement of the distance between each side of the fiber to determine the fiber diameter using the best optical degree. Generally, between 20 to 50 measures were taken to determine the mean value.

Fabric Weight

Fabric weight or mass per unit area [g/m2] was measured according to EDANA/INDA test procedure NWSP 130.1.R0 (15) or ISO 9073-1:1989.

Tensile Strength and Elongation at Break of the Nonwoven Fabrics

The tensile strength, expressed in [N/50 mm] is the strength of a material when subjected to either pulling or to a compressive stress test, i.e., represents the stress the material can bear without rupturing or tearing. The elongation at break represents the deformation in the direction of load caused by a tensile force at the point of rupture. Elongation is generally expressed as a ratio of the length of the stretched material as a percentage to the length of the unstretched material. Elongation may be determined by the degree of stretch under a specific load or the point where the stretched material breaks.

Tensile strength and elongation at break were determined according to Standard Procedure NWSP 110.4.R0 (15) published by EDANA and INDA using a 50 mm strip tensile at constant-rate-of-extension (CRE). A test specimen is clamped in a tensile testing machine and a force is applied to the specimen until it breaks. Values for the breaking force [N/50 mm] and elongation [%] of the test specimen are obtained.

Ash Content

The ash content in [%] of the fibres and the masterbatches was determined by incineration of a sample in an incineration crucible which is put into an incineration furnace at 570° C. for 2 hours. The ash content is measured as the total amount of remaining inorganic residues.

Air Permeability of Nonwoven Fabrics

The air permeability of the nonwoven fabric samples was determined by using a Textest Air Permeability Tester FX 3300 Labair IV (Textest AG, Schwerzenbach, Switzerland) equipped with the test head FX 3300-IV 20 with a surface area of 20 $cm^2$ according to ISO 9237 (1995). The air permeability is measured in [L/($m^2$ s)].

Materials

PLA1: Polymer 1: PLA polylactic acid:NatureWorks Ingeo™ Biopolymer 6202D (MFR: 15-30 g/10 min (210° C., 2.16 kg) according to technical data sheet), commercially available from NatureWorks, Minnetonka, MN, USA. PLA1 was pre-dried in an oven at 80° C. for 6 h prior to use.

PLA2: Polymer 2: PLA polylactic acid:NatureWorks Ingeo™ Biopolymer 6100D (MFR: 24 g/10 min (210° C., 2.16 kg) according to technical data sheet), commercially available from NatureWorks, Minnetonka, MN, USA. PLA2 was pre-dried in an oven at 80° C. for 6 h prior to use.

PBS: BioPBS, product FZ71PB, bio-based polybutylene succinate (PBS), (MFR: 22 g/10 min (210° C., 2.16 kg), moisture content less than 700 ppm according to technical data sheet), commercially available from PTT MCC Biochem Company Limited, Bangkok, Thailand.

CC1 (inventive): Natural ground calcium carbonate, commercially available from Omya International AG, Switzerland ($d_{50}$: 1.7 μm; $d_{98}$: 6 μm, content of particles <0.5 μm=12%), surface-treated with 1.7 wt. % alkenyl succinic anhydride (CAS [68784-12-3], concentration >93%), based on the total weight of the natural ground calcium carbonate. BET: 3.4 $m^2/g$, residual moisture content: 0.1 wt.-%.

CC2 (inventive): Natural ground calcium carbonate, commercially available from Omya International AG, Switzerland ($d_{50}$: 0.8 μm; $d_{98}$: 3 μm, content of particles <0.5 μm=35%), surface-treated with 0.7 wt. % alkenyl succinic anhydride (CAS [68784-12-3], concentration >93%), based on the total weight of the natural ground calcium carbonate. BET: 8.5 $m^2/g$, residual moisture content: 0.5 wt.-%.

Example 1—Preparation of Masterbatches

Masterbatches containing PLA1 and one of the calcium carbonate fillers CC1 and CC2 were prepared on a lab scale Twin screw extruder (ZSE27HP-40D from Leistritz, Germany). The compositions and filler contents of the prepared masterbatches are compiled in Table 1 below. The precise filler content was determined by the ash content.

TABLE 1

Composition and filler content of prepared masterbatches.

| Masterbatch | Filler | Filler content [wt.-%] | Ash content [wt.-%] | Mineral dispersion quality |
|---|---|---|---|---|
| MB1 (inventive) | CC1 | 50 | 49.6 | good |
| MB2 (inventive) | CC2 | 50 | 50.0 | good |

The results shown in Table 1 confirm that masterbatches with good quality were produced.

Example 2—Preparation of Nonwoven Fabrics (Via Spunlaid Process A with Thermobonding)

Masterbatches according to Example 1 were mixed with polymer PLA2 and/or PBS and were directly dosed together into a single screw extruder equipped with a melt pump. Nonwoven fabrics were produced from these mixtures on a Hills spunbond pilot line, width 550 mm (Hills Inc. West Melbourne, Florida; USA), equipped with a spin pack with 1003 holes/500 mm, 0.35 mm hole diameter. The extruder temperature was set at 220-225° C. with a throughput of 0.6 g/hole/min. The quenching temperature was 14° C. at 830 mm distance. The extruded filaments were produced with filament speed at 2900 m/min with a fiber gap of 5.33 mm and 1.5 bar air pressure and formed into a nonwoven web. The filament laying distance was 600 mm and conveyor the belt speed was adjusted to receive 15 and 50 gsm nonwoven fabric weight.

The calendering (thermobonding) process was used for the bonding of the nonwoven web with an Andritz Nexcal XT type 410.11×800 LSR, machine width 600 mm (Andritz Kuesters, Krefeld, Germany) with a smooth and an engraved roll. The temperature of the roll was set between 135-150° C. The rolls are heated (by circulating heated oil) and the temperature is measured (by temperature sensor into the rolls oil feeding pipes and the surface temperature is measured with a contact-type surface temperature meter).The engraving roll has an ovoid pattern with a bonding area of 18.1%, the points density is 43.9 points/$cm^2$ and the engraving depth is 0.68 mm. The linear pressure was set to 30 N/mm.

The compositions and properties of the produced nonwoven materials are compiled in Table 2 below.

TABLE 2

Compositions and properties of the prepared nonwoven fabrics (wt.-% is based on total weight of the sample).

| Sample | Composition | | | Basis weight [g/$m^2$] | Tensile strength [N/50 mm] MD | Tensile strength [N/50 mm] CD | Elongation at break [%] MD | Elongation at break [%] CD | Air permeability [L/($m^2$ s)] |
|---|---|---|---|---|---|---|---|---|---|
| 1 | PLA2 (100) | | | 52.2 | 70.4 | 50.2 | 18.4 | 17.4 | 1.573 |
| 2 | PLA2 (80) | MB1 (20) | | 51.5 | 103.5 | 54.7 | 26.9 | 23.8 | 1.783 |
| 3 | PLA2 (80) | MB2 (20) | | 51.1 | 102.1 | 46.9 | 24.7 | 26.4 | 1.707 |
| 4 | PLA2 (100) | | | 15.5 | 17.2 | 7.9 | 14.5 | 14.2 | 6.247 |
| 5 | PLA2 (80) | MB1 (20) | | 15.3 | 21.1 | 8.0 | 15.7 | 16.3 | 7.373 |
| 6 | PLA2 (80) | MB2 (20) | | 15.4 | 22.2 | 9.1 | 18.9 | 20.3 | 7.127 |
| 7 | PLA2 (75) | MB1 (20) | PBS (5) | 15.1 | 22.4 | 12.6 | 19.7 | 25.9 | 7.016 |
| 8 | PLA2 (75) | MB2 (20) | PBS (5) | 15.2 | 27.9 | 11.5 | 24.3 | 23.5 | 5.843 |

As can be gathered from Table 2, the addition of the inventive fillers significantly increased the tensile strength of the calendered nonwoven fabric in machine direction (MD), whereas the tensile strength in cross direction (CD) was retained or increased. At the same time, the elongation at break in MD and CD, as well as the air permeability is increased by the addition of the inventive fillers.

Example 3—Preparation of Nonwoven Fabrics (Via Spunlaid Process B with Thermobonding)

Masterbatches according to Example 1 were mixed with polymer PLA1 or PLA2 and were directly dosed together into a single screw extruder equipped with a melt pump. Nonwoven fabrics were produced from these mixtures on a Reicofil 4 pilot line, 1 meter width (Reifenhäuser Reicofil GmbH & Co. KG, Troisdorf, Germany), equipped with a spin pack with 7377 holes, core/sheath configuration, 0.6 mm hole diameter. Extruder temperature at 220° C., die temperature at 240° C. with a throughput of 0.77 to 0.90 g/hole/min. The quenching temperatures were at 35°/25° C. and the cabin pressure was set to 9000 Pa. The extruded filaments were formed into a nonwoven web.

The calendering (thermobonding) process was used for the bonding of the nonwoven web with an Andritz Kuesters type 419.40A with HOT-S-ROLL 275 "Twin", machine width 1300 mm (Andritz Kuesters, Krefeld, Germany) with a smooth and an engraved roll. The temperature of the roll was set between 127-147° C. The rolls are heated (by circulating heated oil) and the temperature is measured (by temperature sensor into the rolls oil feeding pipes and the surface temperature is measured with a contact-type surface temperature meter).The engraving roll has a U 2888 pattern with a bonding area of 18.1%, the points density is 49.9 points/cm$^2$ and the engraving depth is 0.68 mm. The linear pressure was set to 50 N/mm.

The final bonded nonwoven fabrics had a target fabric weight of 30 and 50 g/m$^2$, which was adjusted by the line speed. The compositions and properties of the produced nonwoven materials are compiled in Table 3 below.

TABLE 3

Compositions and properties of the prepared nonwoven fabrics (wt.-% is based on total weight of the sample).

| Sample | Composition | | Basis weight [g/m$^2$] | Tensile strength [N/50 mm] MD | Tensile strength [N/50 mm] CD | Elongation at break [%] MD | Elongation at break [%] CD |
|---|---|---|---|---|---|---|---|
| 1 | PLA2 (100) | | 49.3 | 33.5 | 9.4 | 5.2 | 13.8 |
| 2 | PLA2 (90) | MB1 (10) | 47.0 | 52.8 | 10.9 | 7.0 | 13.0 |
| 3 | PLA2 (80) | MB1 (20) | 52.3 | 71.5 | 18.4 | 9.4 | 16.9 |
| 4 | PLA1 (80) | MB1 (20) | 50.3 | 81.9 | 21.8 | 12.8 | 20.2 |
| 5 | PLA1 (70) | MB1 (30) | 51.0 | 76.7 | 23.5 | 11.5 | 22.8 |
| 6 | PLA1 (80) | MB2 (20) | 29.5 | 31.4 | 6.8 | 6.2 | 17.8 |
| 7 | PLA1 (70) | MB1 (30) | 29.8 | 32.1 | 8.4 | 6.5 | 14.7 |

As can be gathered from Table 3, the addition of the inventive fillers significantly increased the tensile strength of the calendered nonwoven fabric in MD, whereas the tensile strength in CD was retained or increased. At the same time, the elongation at break in MD and CD is increased by the addition of the inventive fillers.

Example 4—Preparation of Nonwoven Fabrics (Via Spunlaid Process with Hydro-Entanglement)

This example was designed to obtain soft and less rigid nonwoven fabrics. As representative parameters, the elongation at break and the air permeability of the nonwoven fabrics were measured. Masterbatches according to Example 1 were mixed with polymer PLA1 or PLA2 and were directly dosed together into a single screw extruder equipped with a melt pump. Nonwoven fabrics were produced from these mixtures on a Hills spunbond pilot line, width 550 mm (Hills Inc. West Melbourne, Florida; USA), equipped with a spin pack with 1003 holes/500 mm, 0.35 mm hole diameter. The extruder temperature was set at 220-225° C. with a throughput of 0.6 g/hole/min. The quenching temperature was 14° C. at 830 mm distance. The extruded filaments were produced with filament speed at 2900 m/min with a fiber gap of 5.33 mm and 1.5 bar air pressure and formed into a nonwoven web. The filament laying distance was 610 mm and conveyor the belt speed was adjusted to receive 40 and 70 gsm nonwoven fabric weight.

The hydroentanglement process was used for bonding of the nonwoven web with an Andritz Jetlace 3000, machine width 600 mm (Andritz Perfojet SAS, Montbonnot, France). Pre-bonding was performed at 80 bar water pressure. The bonding was performed with 2 cylinders and 4 injectors (2J12 strips at 2 rows with diameter 120 μm and 1.2 mm gap) in two bonding steps. Bonding was performed at a water pressure of 200 bar. The nonwoven fabrics were dried at 90° C. with high air flow in an omega oven. The compositions and properties of the produced nonwoven materials are compiled in Table 4 below.

TABLE 4

Compositions and properties of the prepared nonwoven fabrics (wt.-% is based on total weight of the sample).

| Sample | Composition | | Basis weight [g/m$^2$] | Elongation at break [%] MD | Elongation at break [%] CD | Air permeability [L/(m$^2$ s)] |
|---|---|---|---|---|---|---|
| 1 | PLA2 (100) | | 41.2 | 46.4 | 80.3 | 4,367 |
| 2 | PLA2 (80) | MB1 (20) | 42.1 | 36.7 | 88.5 | 4,450 |
| 3 | PLA2 (80) | MB2 (20) | 41.9 | 29.1 | 69.3 | 4,360 |
| 4 | PLA2 (100) | | 69.7 | 47.2 | 77.9 | 2,620 |
| 5 | PLA2 (80) | MB1 (20) | 70.9 | 33.0 | 71.0 | 2,473 |
| 6 | PLA2 (80) | MB2 (20) | 70.9 | 22.5 | 61.2 | 2,613 |

As can be gathered from Table 4, the hydroentangled nonwoven fabrics comprising the inventive fillers had an MD and CD elongation at break comparable to the unfilled nonwoven fabric. At the same time, also the air permeability of the inventive nonwoven fabrics was retained. Consequently, the inventive nonwoven fabrics are less rigid and softer than the unfilled nonwoven fabrics, i.e., show desirable haptic properties while maintaining acceptable mechanical properties.

Example 5—Tactile Properties Testing with Sensorics Panel

The tactile properties were evaluated with a sensorics panel. The purpose is to characterize the tactile properties of nonwoven fabric samples in a comparative way by means of human perception. The retained sensory methodology is an analytic quantitative approach permitting to describe and position the studied nonwoven fabrics on every pertinent tactile components generated by the panel (descriptors) in an adapted lexicon (monadic sensory profile: study one by one) based on the standard NF ISO 13299:2016.

The sensory expert tactile panel was composed of 9 experienced and trained persons. The descriptors, which were determined by the panel, are given in Table 5.

TABLE 5

| Sensory descriptors | | | |
|---|---|---|---|
| Descriptor | Rating | Description | Testing Method |
| Softness | 0-the least soft<br>10-the softest | Overall feeling of the touch of the material with an individual perceptive character. | Stroke the surface of the material without pressure and in both directions. Judge the pleasant aspect of the material. |
| Downiness | 0-the least downy<br>10-the most downy | Describes the presence of fibers in the surface of the material. | Appose the hand flat on the surface of the sample without pressure. Make microdeplacement of the digital pulp by small circular movements on the surface of the material, so as the fibers to roll under the fingers. |
| Fluidity | 0-the least fluid<br>10-the most fluid | Describes the ease with which the sample glides and flows between the finders (lack of manipulation resistancy) | Seize the sample by a corner and slide the material in the hollow of the other hand. |
| Tearability | 0-the least tearable<br>10-the most tearable | Describes the capacity of the material to burst after tearing | Seize the sample with both hands by a side like a sheet of paper and tear the material until rupture |
| Elasticity | 0-the least elastic<br>10-the most elastic | Describes the capacity of the material to recover its shape after being submitted to a stretching of both hands | Seize the sample in both hands in the diagonal and slowly exercise a delicate strength of tear on the material (answer to the deformation) |

The sensory test results were verified on statistical reliability by the mean of interferential statistic tools: ANOVA and Friedman Test.

The haptics characterization of the nonwoven samples revealed a tactile profile of the samples with significant differences. These differences are statistically relevant and unique. The results are summarized in Table 6.

TABLE 6

| Results of the tactile properties testing. | | | | | |
|---|---|---|---|---|---|
| | Descriptor | | | | |
| Sample | Softness | Downiness | Fluidity | Tearability | Elasticity |
| 3 of Example 3 (inventive) | 8.2 | 5.6 | 9.7 | 8.7 | 6.3 |
| 1 of Example 3 (comparative) | 7.7 | 4.3 | 8.9 | 6.7 | 3.5 |

The invention claimed is:

1. A process for producing a nonwoven fabric, the process comprising the following steps:

a) providing a surface-treated calcium carbonate-containing filler material, the surface-treated calcium carbonate-containing filler material being a calcium carbonate-containing filler material and a surface-treatment layer on at least a part of the surface of said calcium carbonate-containing filler material, wherein the surface-treatment layer is formed by contacting the calcium carbonate-containing filler material with a surface treatment agent, wherein the surface treatment agent comprises at least one mono-substituted succinic anhydride and/or mono-substituted succinic acid and/or a salt thereof;

b) providing a first polylactic acid polymer;

c) providing a second polylactic acid polymer being different from the first polylactic acid polymer;

d) forming a masterbatch consisting of the surface-treated calcium carbonate-containing filler material of step a) in an amount of from 20 to 80 wt.-%, based on the total weight of the masterbatch, with the first polylactic acid polymer of step b);

e) mixing the masterbatch of step d) with the second polylactic acid polymer of step c) to obtain a mixture, the mixture consisting of the masterbatch of step d) and the second polylactic acid polymer of step c);

f) forming the mixture of step e) into fibers;

g) forming a fibrous web from the fibers of step f); and h) forming the non-woven fabric by calendering or hydroentanglement of the fibrous web of step g).

2. The process of claim 1, wherein the calcium carbonate-containing filler material has prior to the surface treatment i) a weight median particle size ($d_{50}$) value in the range from 0.1 μm to 7 μm, ii) a top cut ($d_{98}$) value of 15 μm or less, iii) a specific surface area (BET) from 0.5 to 120 $m^2/g$, as measured by the BET method, and/or iv) a residual total moisture content from 0.01 wt.-% to 1 wt.-%, based on the total dry weight of the at least one calcium carbonate-containing filler material.

3. The process of claim 1, wherein the mixture of step e) has a surface-treated calcium carbonate-containing filler material content in the range of 5 to 25 wt.-%, based on the total weight of the mixture.

4. The process of claim 1, wherein the fibers formed in step f)

are filaments having an average fiber diameter in the range from 9 to 25 μm, and/or a titer in the range from 1 to 6 dtex, as measured by EN ISO 2062:2009, and/or are formed from the mixture of step e) by spunbonding.

5. The process of claim 1, wherein the fibers formed in step f) are staple fibers having an average fiber diameter in the range from 9 to 25 μm, and/or a titer in the range from 1 to 6 dtex, as measured by EN ISO 2062:2009 and/or a staple fiber length in the range from 30 to 90 mm.

6. The process of claim 1, wherein the non-woven fabric is formed in step h) by hydroentanglement.

7. The process of claim 1, wherein the non-woven fabric is formed in step h) by calendering.

* * * * *